US009431752B2

(12) United States Patent
Sekino et al.

(10) Patent No.: US 9,431,752 B2
(45) Date of Patent: Aug. 30, 2016

(54) CONNECTOR DEVICE

(71) Applicant: YAZAKI CORPORATION, Minato-ku, Tokyo (JP)

(72) Inventors: Tetsuya Sekino, Shizuoka (JP); Nobuyuki Sakamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/872,712

(22) Filed: Oct. 1, 2015

(65) Prior Publication Data

US 2016/0028179 A1 Jan. 28, 2016

Related U.S. Application Data

(63) Continuation of application No. PCT/JP2014/060000, filed on Apr. 4, 2014.

(30) Foreign Application Priority Data

Apr. 8, 2013 (JP) ..... 2013-080428

(51) Int. Cl.

| | |
|---|---|
| ***H01R 13/631*** | (2006.01) |
| ***H01R 13/629*** | (2006.01) |
| ***H01R 31/06*** | (2006.01) |
| ***H01R 13/502*** | (2006.01) |
| ***H01R 13/506*** | (2006.01) |
| ***H01R 13/508*** | (2006.01) |
| ***H01R 35/04*** | (2006.01) |

(52) U.S. Cl.

CPC ..... *H01R 13/502* (2013.01); *H01R 13/506* (2013.01); *H01R 13/508* (2013.01); *H01R 35/04* (2013.01)

(58) Field of Classification Search

CPC .. H01R 13/631; H01R 13/629; H01R 13/64; H01R 35/04; H01R 31/06; H01R 24/38; H01R 2107/00

USPC ..... 439/374, 376, 11

See application file for complete search history.

(56) References Cited

U.S. PATENT DOCUMENTS

| | | | | |
|---|---|---|---|---|
| 7,601,020 | B2 * | 10/2009 | Yoshida | H01R 13/64 439/374 |
| 7,909,658 | B2 * | 3/2011 | Pfaffenbach | H01R 13/6273 439/133 |
| 2009/0269960 | A1 | 10/2009 | Holland | |
| 2010/0003841 | A1 | 1/2010 | Metzler et al. | |

(Continued)

FOREIGN PATENT DOCUMENTS

| | | | |
|---|---|---|---|
| JP | 2010-165483 | A | 7/2010 |
| JP | 2011-519135 | A | 6/2011 |
| JP | 2014-143160 | A | 8/2014 |

*Primary Examiner* — Gary Paumen

(74) *Attorney, Agent, or Firm* — MOTS Law, PLLC

(57) ABSTRACT

A connector device includes a wire harness side connector including a first housing, and a sensor side connector including a second housing. The first connector includes a third housing provided so as to be freely rotatable in the first housing. The first housing rotates with respect to the third housing and is fitted to the second housing. The first housing is freely movable with respect to the third housing in the axial direction between a pre-fitting position and a fitting completion position and has a force applied thereto by a spring on the pre-fitting position side. A rotational position return mechanism is provided that returns, when the connector fitting is released, the rotational position of the first housing to an initial rotational position during a process in which the first housing is moved from the fitting completion position to the pre-fitting position by an elastic force of the spring.

6 Claims, 18 Drawing Sheets

(56) References Cited

U.S. PATENT DOCUMENTS

2010/0178789 A1 7/2010 Ohmori et al.
2010/0240242 A1* 9/2010 Pfaffenbach ..... H01R 13/6273 439/353
2014/0357114 A1* 12/2014 Pankau ..... H01R 13/6272 439/372
2015/0288103 A1* 10/2015 Sekino ..... G01L 19/0084 439/374

* cited by examiner

CONNECTOR DEVICE

CROSS REFERENCE TO RELATED APPLICATIONS

This application is a continuation of International Application No. PCT/JP2014/060000, filed Apr. 4, 2014, and based upon and claims the benefit of priority from Japanese Patent Application No. 2013-080428, filed Apr. 8, 2013, the entire contents of all of which are incorporated herein by reference.

TECHNICAL FIELD

The present application relates to a connector device which fits between a pair of housing parts, thereby electrically connecting respective terminals provided in the pair of housing parts, with each other.

BACKGROUND ART

Conventionally, there have been proposed a variety of connector devices each installed in an engine (see US 2010/0003841 A1). A conventional example of such a connector device is illustrated in FIG. 18. As illustrated in FIG. 18, a conventional connector device 50 is installed in a cylinder head 70 of an engine to pick up an output of a built-in fuel pressure sensor element (not illustrated). The conventional connector device 50 includes a wire harness side connector 51 and a sensor side connector 60.

The wire harness side connector 51 includes a housing part 52. A first terminal 53 is disposed in an interior portion on one end side of the housing part 52. An external terminal 54 is disposed in an interior portion on the other end side of the housing part 52. The first terminal 53 is connected to the external terminal 54 through wires W accommodated in the housing part 52. The housing part 52 includes a connector fitting part 52*a* housing the external terminal 54. An external connector (not illustrated) is fitted to the connector fitting part 52*a*.

The sensor side connector 60 includes a sensor body part 61 in which a sensor element (not illustrated) is disposed, and a housing part 63 which is fixed to the sensor body part 61 and in which a second terminal 62 is disposed. A threaded part 61*a* is formed on the outer circumference of the sensor body part 61. By screwing the sensor body part 61 into a threaded hole 70*a* of the cylinder head 70, the sensor side connector 60 is installed in the cylinder head 70.

With the above mentioned constitution, the sensor side connector 60 is installed in the cylinder head 70 and thereafter, a head cover 71 is mounted on the cylinder head 70. Then, the wire harness side connector 51 is inserted into a hole 71*a* of the head cover 71 and fitted to the sensor side connector 60.

The sensor side connector 60 is screw fastened to the threaded hole 70*a* of the cylinder head 70. Accordingly, the rotational position (orientation) of the housing part 63 of the sensor side connector 60 is non-constant and furthermore, when fitting the wire harness side connector 51, the housing part 63 of the sensor side connector 60 is located deep in the hole 71*a* of the head cover 71. Therefore, the housing part 63 of the sensor side connector 60 cannot be visually recognized clearly, so that it is difficult to align the housing part 52 of the wire harness side connector 51 with a formal fitting rotational position with respect to the housing part 63 of the sensor side connector 60, causing a problem of inferior fitting workability.

In such a situation, this applicant has proposed a connector device having good fitting workability. This connector device includes a first connector including a first housing part in which a first terminal is disposed, and a second connector including a second housing part in which a second terminal is disposed. In operation, the first housing part and the second housing part are fitted to each other, and the first terminal and the second terminal are connected together at a fitting completion position. Then, the first connector includes a third connector rotatably attached to the first housing part, while the third connector includes a third housing part in which a third terminal is disposed. In the connector device, the first terminal and the third terminal are connected to each other through a wire. The first housing parts is provided with a guide rib part, while the third housing parts is provided with a rotational direction guiding part which guides the guide rib part in a manner that the first housing part and the second housing part are brought into their formal fitting rotational positions by the time when the first terminal and the second terminal start to come into contact with each other.

With the above mentioned constitution, even if the rotational position of the second housing part cannot be specified, the fitting operation between the first housing part and the second housing part could be accomplished with ease. Additionally, as the first terminal and the third terminal are connected to each other through the wire, it is possible to realize the improvement of reliability with respect to electrical connection, reduction in number of components, etc. in comparison with electrical connection using contacts, such as rotational contacts.

SUMMARY

By the way, in the above mentioned connector device, when the fitting of the first connector on the wire harness side to the second connector on the sensor side is released, the wire in the first connector becomes remained to be twisted. Additionally, with re-fitting of the connectors, an excessive twist may occur in the wire. The twisting of the wire is not preferable due to stress on the wire, etc.

In order to solve the above mentioned problem, therefore, an object of the present application is to provide a connector device which allows for the connector fitting action and which can prevent a wire from being twisted in a connector separated state as much as possible.

A connector device according to an aspect of the present application includes: a first connector including a first housing part in which a first terminal is disposed; and a second connector including a second housing part in which a second terminal is disposed. The first connector includes a third housing part provided so as to be rotatable to the first housing part. The third housing part is provided with an external connector fitting part in which a third terminal is disposed. The third terminal and the first terminal are connected to each other through a wire. When the fitting orientation of the first housing part is different from the fitting orientation of the second housing part, the first housing part rotates in relation to the third housing part, thereby fitting the second housing. The first terminal is connected to the second terminal under condition that fitting of the connectors is complete. The first housing part is axially movable to the third housing part between a pre-fitting position thereof and a fitting completion position thereof, the first housing part being urged toward the pre-fitting position by an urging member. The connector device is provided with a rotational position return mechanism that returns, when the fitting of the connectors is released, the rotational position of the first housing part to an initial rotation position thereof during a process in which the first housing part is moved from the fitting completion position to the pre-fitting position by an urging force of the urging member.

Preferably, the connector device further includes a rotation preventing mechanism that prevents the first housing part under the pre-fitting position from rotating to the third housing part.

The rotational position return mechanism may include: a guide rail provided in one of the first housing part and the third housing part; and a guide pin guided by the guide rail during an axial movement of the first housing part from the fitting completion position up to the pre-fitting position.

An inner cylindrical body may be rotatably attached to the first housing part. The third housing part may be rotatably attached to the first housing part through the inner cylindrical part. The rotational position return mechanism may include: a first guide rail provided in one of the third housing part and the inner cylindrical body; a second guide pin provided in the other of the third housing part and the inner cylindrical body and also guided by the first guide rail during an axial movement of the first housing part from the fitting completion position up to the pre-fitting position; a second guide rail provided in one of the inner cylindrical body and the first housing part; and a third guide pin provided in the other of the inner cylindrical body and the first housing part and also guided by the second guide rail during the axial movement of the first housing part from the fitting completion position up to the pre-fitting position.

The inner cylindrical body may be provided, in each of vertically symmetric positions thereof, with one of the first guide rail and the second guide pin and one of the second guide rail and the third guide pin.

One of the first housing part and the second housing part may be provided with a guide rib, while the other of the first housing part and the second housing part may be provided with a rotational direction guiding part that guides the guide rib so that even if the guide rib is positioned in any rotational position, the first housing part and the second housing part would be brought into formal fitting rotational positions by a position previous to the time when the first terminal and the second terminal start to come into contact with each other, whereby the first housing part rotates to fit the second housing when the fitting orientation of the first housing part is different from the fitting orientation of the second housing part.

With the aspect of the present application, at the time of connector fitting, when the first housing part is subjected to pressing force from the second housing, the first housing part moves from the pre-fitting position toward the fitting completion position against urging force of the urging member. If the fitting orientation of the first housing part is different from the fitting orientation of the second housing part, then the first housing part rotates to the third housing part to face the formal fitting rotational position and fits the second housing part. At the time of releasing the connector fitting, meanwhile, when the pressing force from the second housing part to the first housing part is released, the first housing part moves from the fitting completion position to the pre-fitting position by the urging force of the urging member. In the process of this movement, the rotating direction of the first housing part is returned to the initial rotational position by the initial position return mechanism. Therefore, it is possible to accomplish the connector fitting action and also possible to prevent the wire from being twisted in the connector separated state, as much as possible.

DESCRIPTION OF EMBODIMENTS

Figure 1:
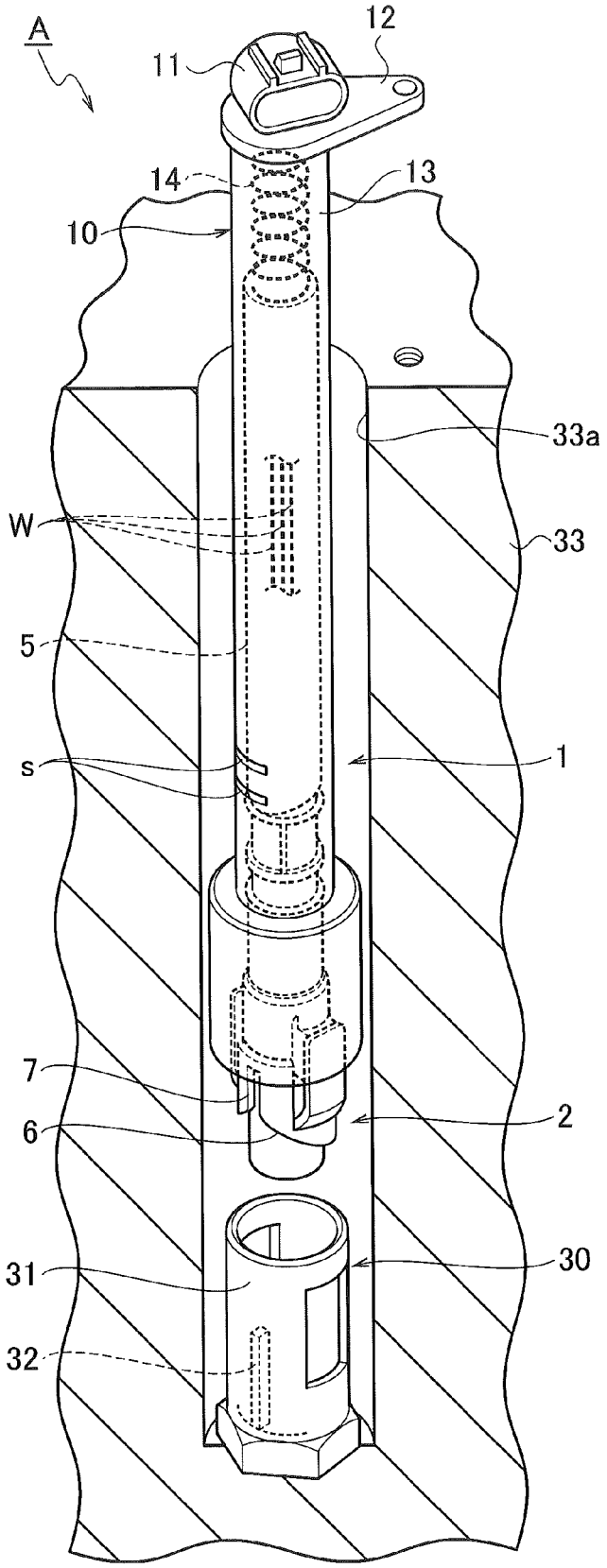
FIG. 1 is a perspective view of the connector device according to a first embodiment in a pre-fitting condition.

Embodiments of the present application will be described with reference to FIGS. 3 to 14.

First Embodiment

FIGS. 1 to 8 illustrate a first embodiment. As illustrated in FIGS. 1 to 4, a connector device A according to the first embodiment includes a built-in combustion pressure sensor (not illustrated) and is mounted on e.g. an engine head. The connector device A includes a wire harness side connector 1 as a first connector, and a sensor side connector 30 as a second connector.

The wire harness side connector 1 includes a first housing part 2 including a built-in first terminal (not illustrated), and a third housing part 10 rotatably supported by the first housing part 2. An inner cylindrical body 5 is fixed on the top of the first housing part 2 coaxially, by fitting between fitting pins pin 2*a* and fitting grooves 13*a*.

The third housing part 10 includes an external connector fitting part 11 having a built-in third terminal (not illustrated), an attachment flange part 12, and an outer cylindrical body 13. The external connector fitting part 11, the attachment flange part 12, and the outer cylindrical body 13 constitute an integral member. The third terminal and the first terminal are connected to each other through electrical wires W routed in the outer cylindrical body 13. Each of the wires W is routed with a surplus length allowing it to be twisted. The external connector fitting part 11 defines a direction generally perpendicular to the fitting direction of the first housing part 2. Fitted into the external connector fitting part 11 is an external connector (not illustrated) which is connected to a wire harness (not illustrated) on a side of a vehicle body. In the outer cylindrical body 13, its upper part is formed with a small diameter, while the lower part is formed with a large diameter.

Figure 5:
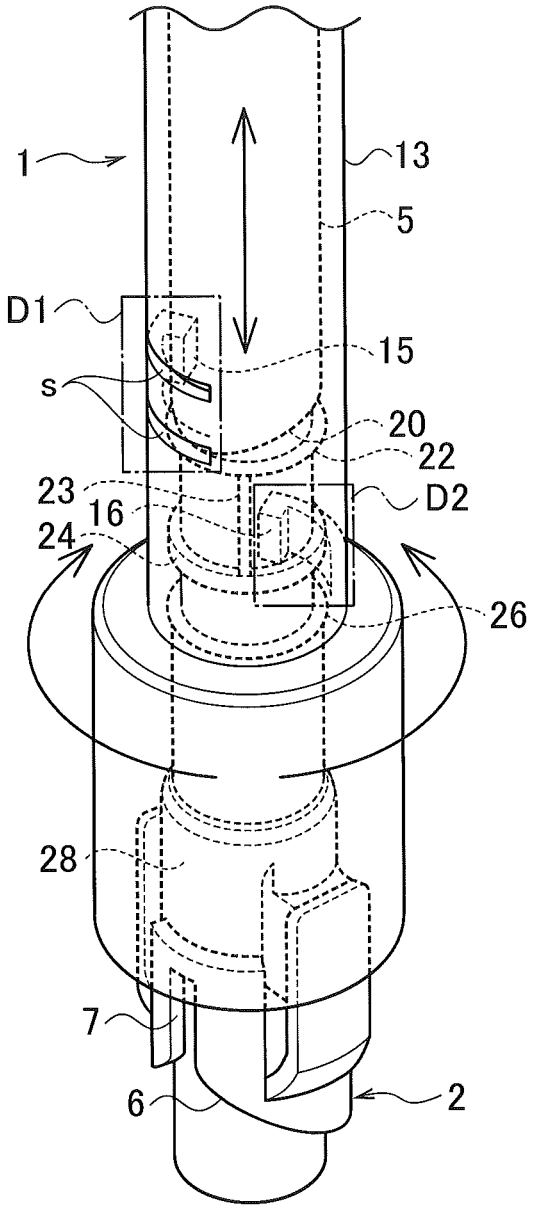
FIG. 5 is a perspective view of a first housing accommodated in an outer cylindrical body of a third housing of the connector device according to the first embodiment.

Inside the outer cylindrical body 13, as illustrated in FIG. 5, the first housing part 2 and the inner cylindrical body 5 are accommodated so as to be movable in the axial direction and also rotatable about their own axes. The first housing part 2 and the inner cylinder body 5 rotate integrally. The lower part of the first housing part 2 is exposed from the lower end of the outer cylindrical body 13. The first housing part 2 and the inner cylindrical body 5 are urged against a pre-fitting position by elastic force of a spring 14 as an urging member housed in the outer cylindrical body 13. However, their axial moving ranges and rotatable positions in relation to the outer cylindrical body 13 are restricted by the following structure. The structure will be described below.

Figure 6A:
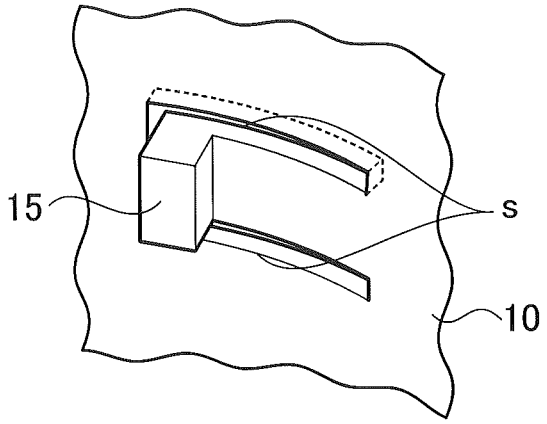
FIG. 6A is a perspective view of a part D1 of FIG. 5, viewed from its inner face and, FIG. 6B is a perspective view of a part D2 of FIG. 5.
Figure 6B:
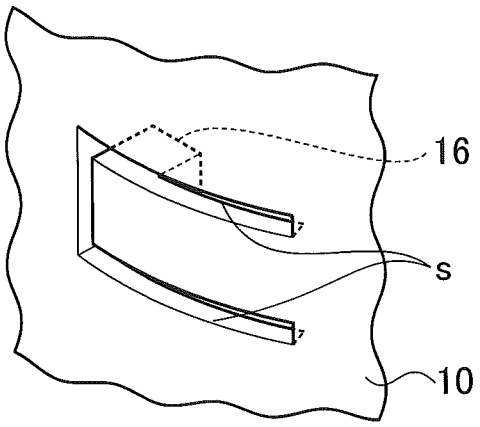

As illustrated in FIGS. 5 and 6, the outer cylindrical body 13 is provided with a first guide pin 15 and a second guide pin 16 which protrude from an inner surface of the outer cylindrical body 13. The first guide pin 15 and the second guide pin 16 are arranged in respective rotational positions located an angle of substantially 180 degrees apart. With pressing forces applied from the inside, the first guide pin 15 and the second guide pin 16 can withdraw from the inner surface outwardly due to elastic displacements of respective slits s.

As illustrated in FIGS. 7A to 7D and 8A to 8D, the inner cylindrical body 5 is provided, in order from its upper position toward the lower position, with a guide rail 20 arranged over the entire circumference in the circumferential direction, a first vertical restriction wall 21 arranged along the axial direction, a first horizontal restriction wall 22 arranged in the circumferential direction, a second vertical restriction wall 23 arranged along the axial direction, a second horizontal restriction wall 24 arranged in the circumferential direction, a third vertical restriction wall 25 arranged along the axial direction, a third horizontal restriction wall 26 arranged over the entire circumference in the circumferential direction, a fourth vertical restriction wall 27 arranged along the axial direction, and a fourth horizontal restriction wall 28 arranged over the entire circumference in the circumferential direction.

Figure 7A:
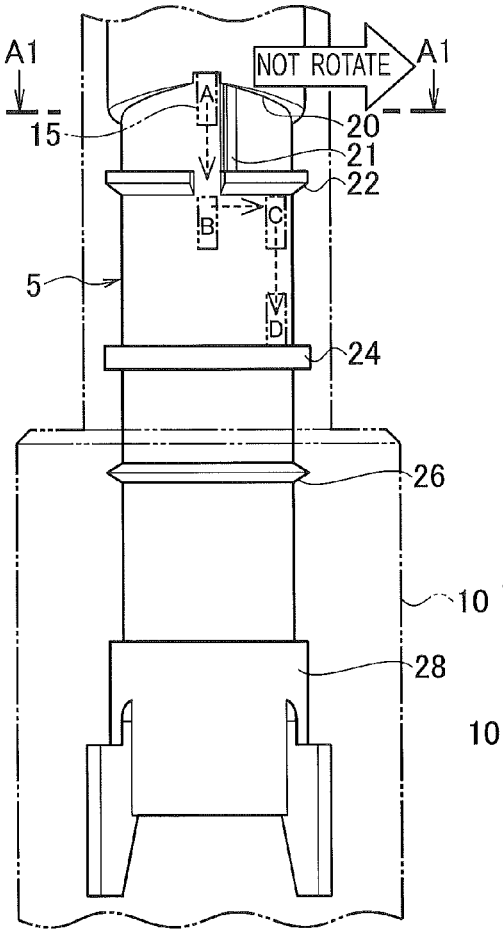
FIG. 7A is a view illustrating the movement trace of a first lock part in the connector fitting process of the connector device according to the first embodiment.
Figure 7B:
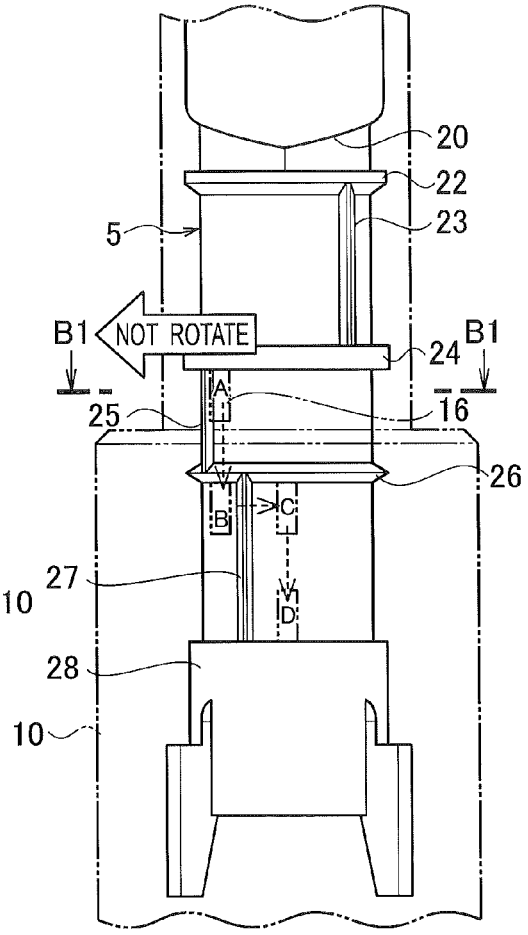
FIG. 7B is a view illustrating the movement trace of a second lock part in the connector fitting process of the connector device according to the first embodiment
Figure 7C:
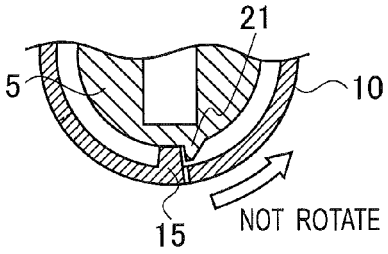
FIG. 7C is a sectional view taken along a line Al-Al of FIG. 7A.
Figure 7D:
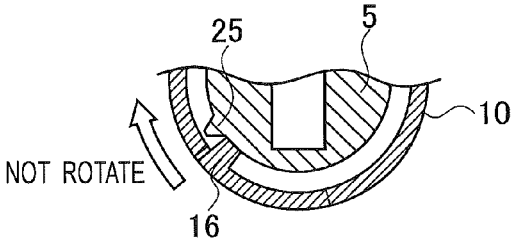
FIG. 7D is a sectional view taken along a line B1-B1 of FIG. 7B.

In the pre-fitting position of the inner cylindrical body 5, the inner cylindrical body 5 is subjected to the elastic force of the spring 14 under condition that the first guide pin 15 abuts on the uppermost face of the guide rail 20, while the second guide pin 16 abuts on the second horizontal restriction wall 24, it has received the elastic force of the spring 14, as illustrated in FIGS. 7A and 7B. Thus, the first housing part 2 is adapted so as not to fall off from the downside of the outer cylindrical body 13 under the connector pre-fitting (connector fitting releasing) condition.

Figure 8A:
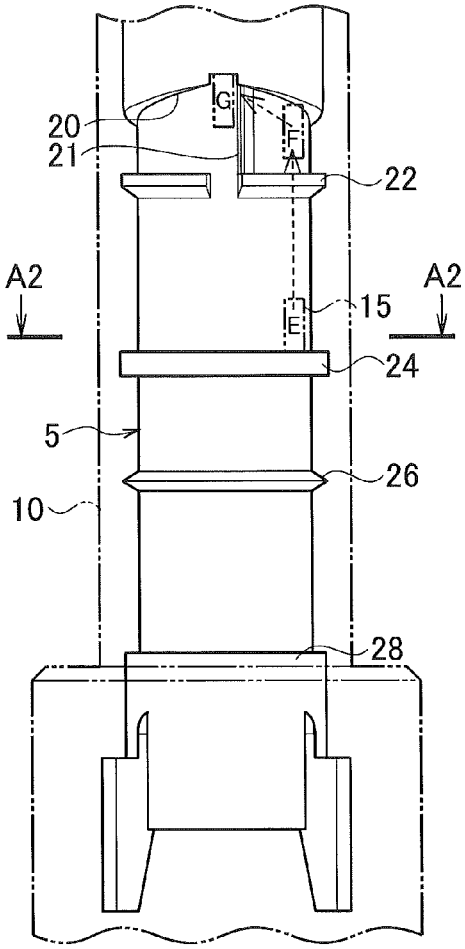
FIG. 8A is a view illustrating the movement trace of the first lock part in the connector fitting releasing process of the connector device according to the first embodiment.
Figure 8B:
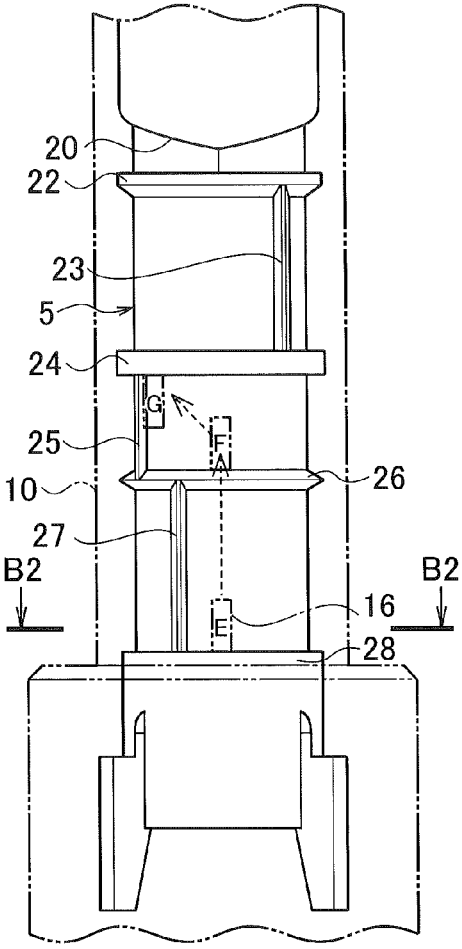
FIG. 8B is a view illustrating the movement trace of the second lock part in the connector fitting releasing process of the connector device according to the first embodiment.
Figure 8C:
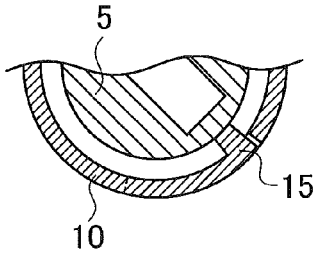
FIG. 8C is a sectional view taken along a line A2-A2 of FIG. 8A.
Figure 8D:
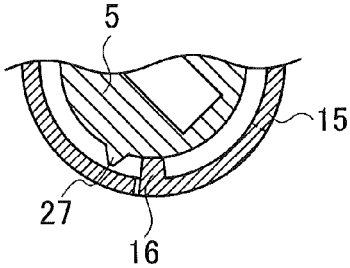
FIG. 8D is a sectional view taken along a line B2-B2 of FIG. 8B.

In the connector fitting completion position of the inner cylindrical body 5, the inner cylindrical body 5 is subjected to pressing force from the sensor side connector 30 under condition that the first guide pin 15 abuts on the second horizontal restriction wall 24, while the second guide pin 16 abuts on the fourth horizontal restriction 28, as illustrated in FIGS. 8A and 8B. Thus, in the connector fitting condition, the first housing part 2 is adapted so as not to enter the interior of the outer cylindrical body 13 anymore.

The positions of the first vertical restriction wall 21 and the third vertical restriction wall 25 are set so as to correspond to a rotation starting position on the side of the pre-fitting position of the inner cylindrical body 5 and a rotation starting position on the side of the connector fitting completion position, respectively.

In a range from the pre-fitting position up to the rotation starting position of the inner cylindrical body 5, the first guide pin 15 is positioned on one side of the first vertical restriction wall 21 (on the left side in FIG. 7A). In the first vertical restriction wall 21, its lateral face on the one side is formed so as to have a vertical surface, thereby preventing the inner cylindrical body 5 from being rotated on the one side (see FIGS. 7A and 7C). In a range from the pre-fitting position up to the rotation enabling position of the inner cylindrical body 5, the second guide pin 16 is positioned on the other side of the third vertical restriction wall 25 (on the right side in FIG. 7B). In the third vertical restriction wall 25, its lateral face on the other side is formed so as to have a vertical surface, thereby preventing the inner cylindrical body 5 from being rotated on the other side (see FIGS. 7B and 7D). That is, the first guide pin 15 and the first vertical restriction wall 21; and the second guide pin 16 and the third vertical restriction wall 25 constitute, in combination, a rotation preventing mechanism which stops the rotation of the first housing part 2 between the pre-fitting position and the rotation starting position.

The guide rail 20 is a circumferential step surface which is the highest at the initial rotational position of the first guide pin 15 and whose height is gradually lowered as increasing the rotational angle from the initial rotational position. Consequently, when the first housing part 2 returns from the connector fitting completion position to the pre-fitting position due to the elastic force of the spring 14 at the time of releasing the connector fitting, the first guide pin 15 returns to the initial rotational position while being guided by the guide rail 20. Therefore, the first guide pin 15 and the guide rail 20 constitute a rotational position return mechanism that returns the rotational position of the first housing part 2 to the initial rotational position during a process where the first housing part 2 is moved from the fitting completion position to the pre-fitting position by the elastic force of the spring 14.

In common with the first vertical restriction wall 21 and the first horizontal restriction wall 22, their respective faces on which the first guide pin 15 abuts in the course of moving from the fitting completion position to the pre-fitting position of the first guide pin 15 are formed to be tapered surfaces. Thus, the first guide pin 15 is adapted so as to be movable over these walls owing to its elastic displacement. In common with the second vertical restriction wall 23 and the third vertical restriction wall 25, their respective faces on which the second guide pin 16 abuts in the course of moving from the fitting completion position to the pre-fitting position of the second guide pin 16 are formed to be tapered surfaces. Thus, the second guide pin 16 is adapted so as to be movable over these walls owing to its elastic displacement.

On the outer circumference of the first housing part 2 on the side of its lower end, there is formed a guide rail face 6 as a rotating direction guide part. The guide rail face 6 is a circumferential rail surface which is the highest at a later mentioned formal fitting rotational position with the second housing part 2 and whose height is gradually lowered as increasing the rotational angle from the fitting rotational position. The guide rail face 6 serves to guide a later mentioned guide rib 32 up to its appropriate fitting rotational position by the time when the first terminal and the second terminal start to come into contact with each other.

The first housing part 2 is formed, on its outer circumference, with a straight guide groove 7 which opens at the highest position of the guide rail face 6 and extends vertically upward.

The sensor side connector 30 includes a second housing part 31. The second housing part 31 has a built-in sensor element (not illustrated) located on the side of its lower end. The second housing part 31 is formed, on the outer circumference of the lower end, with a threaded part (not illustrated). By screwing the threaded part into a threaded hole (not illustrated) of a cylinder head (not illustrated), the sensor side connector 30 is mounted to the cylinder head. The second housing part 31 is cylindrical shaped and formed so as to open at its top surface. Inside the second housing part 31, a second terminal (not illustrated) is disposed so as to face the top surface. The second terminal is provided to pick up an output from the sensor element.

The guide rib 32 is formed so as to project from an inner surface of the second housing part 31. When the tip of the guide rib 32 abuts on the guide rail face 6, the first housing part 2 is rotated in a manner that the guide rib 32 moves up to the highest position of the guide face 6 by a fitting position previous to the time when the first terminal and the second terminal start to come into contact with each other, so that the first housing part 2 and the second housing part 31 move to the formal fitting rotational positions. Thereafter, the guide rib 32 enters the guide groove 7 to initiate a contact between the first terminal and the second terminal. Then, at the fitting completion position where the guide rib 32 penetrates deep into the guide groove 7, the first terminal and the second terminal come into contact with each other appropriately.

With the above mentioned constitution, as illustrated in FIG. 1, the sensor side connector 30 is installed in a cylinder head (not illustrated) and thereafter, the head cover 33 is mounted on the cylinder head. In the head cover 33, a hole 33*a* is formed at the fitting position of the sensor side connector 30. The wire harness side connector 1 is fitted into the head cover through the hole 33*a*.

Here, in the wire harness side connector 1, the first housing part 2 is located in the pre-fitting position. In the pre-fitting position, as illustrated in FIGS. 7A and 7B, the first guide pin 15 abuts on the first vertical restriction wall 21 while the second guide pin 16 abuts on third vertical restriction wall 25, so that normal/reverse rotation between the first housing part 2 and the third housing part 10 is blocked. In this way, it becomes possible to prevent the wires W from being twisted before starting the fitting operation.

Next, the fitting operation of the wire harness side connector 1 will be described. On the assumption of setting the orientation (rotating position) of the external connector fitting part 11 to a desired orientation, it is performed to insert the wire harness side connector 1 into the second housing part 31 of the sensor side connector 30 through the hole 33*a* of the head cover 33. Then, except a situation where the first housing part 2 is inserted into the second housing part 31 at the formal fitting rotational position, the guide rib 32 of the second housing part 31 abuts on an arbitrary part of the guide rail face 6 of the first housing part 2.

When further advancing the fitting from this state, the first housing part 2 receives a reaction force from the guide rib 32. As the first housing part 2 and the inner cylindrical body 5 are prevented from rotating by the rotation preventing mechanism and instead permitted to move in the axial direction, the first housing part 2 and the inner cylindrical body 5 move in relation to the third housing part 10 toward the fitting completion position while resisting the elastic force of the spring 14. When the first housing part 2 is moved up to the rotation starting position (each of the first guide pin 15 and the second guide pin 16 moves from the point A up to the point B of FIGS. 7A and 7B), then the first housing part 2 becomes rotatable. Then, the first housing part 2 is rotated while being guided by the guide ribs 32 and the guide rail face 6, the first housing part 2 occupies a rotational position where the guide rib 32 is located at the uppermost position of the guide rail face 6. In other words, each of the first guide pin 15 and the second guide pin 16 moves from the point B up to point C in FIGS. 7A and 7B. Thus, the first housing part 2 and the second housing part 31 are brought into the formal fitting rotational positions.

Figure 2:
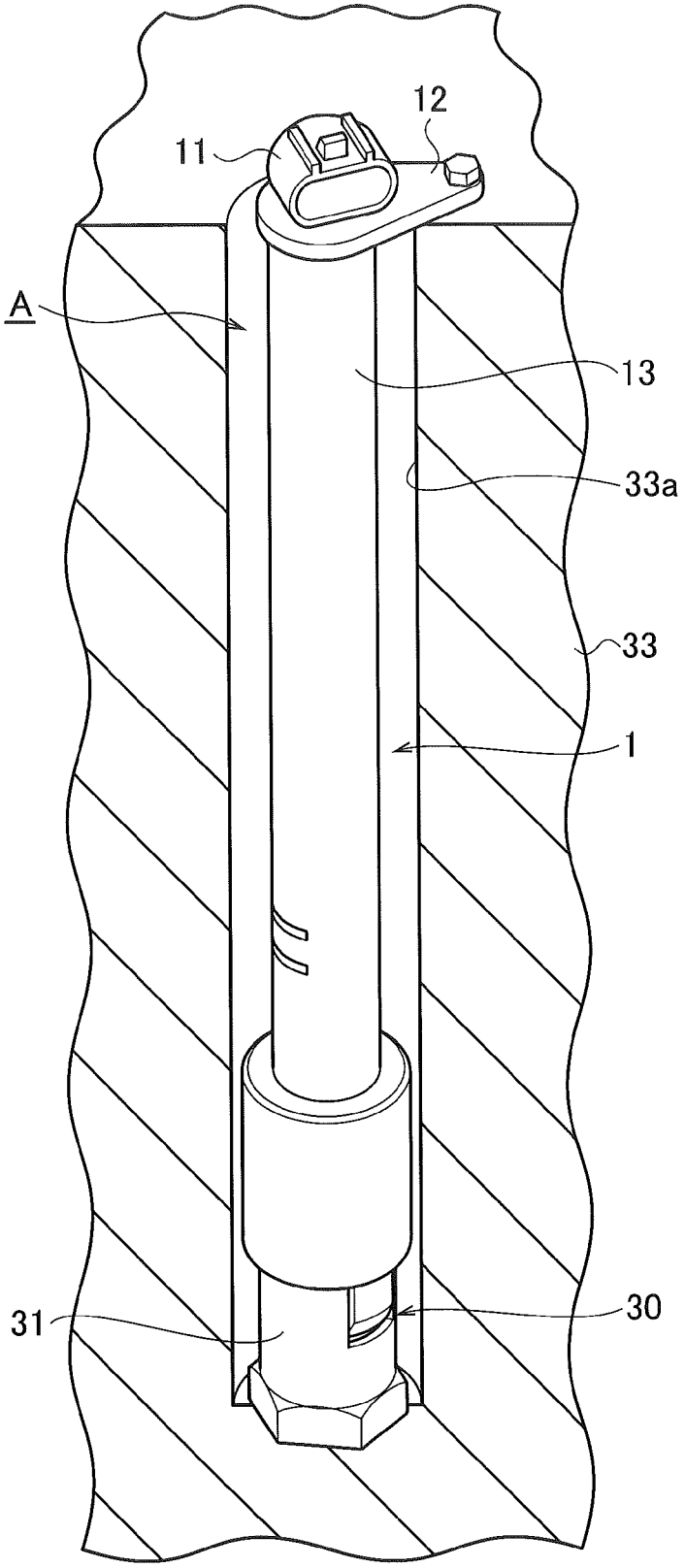
FIG. 2 is a perspective view of the connector device according to the first embodiment in a fitting completion condition.
Figure 3:
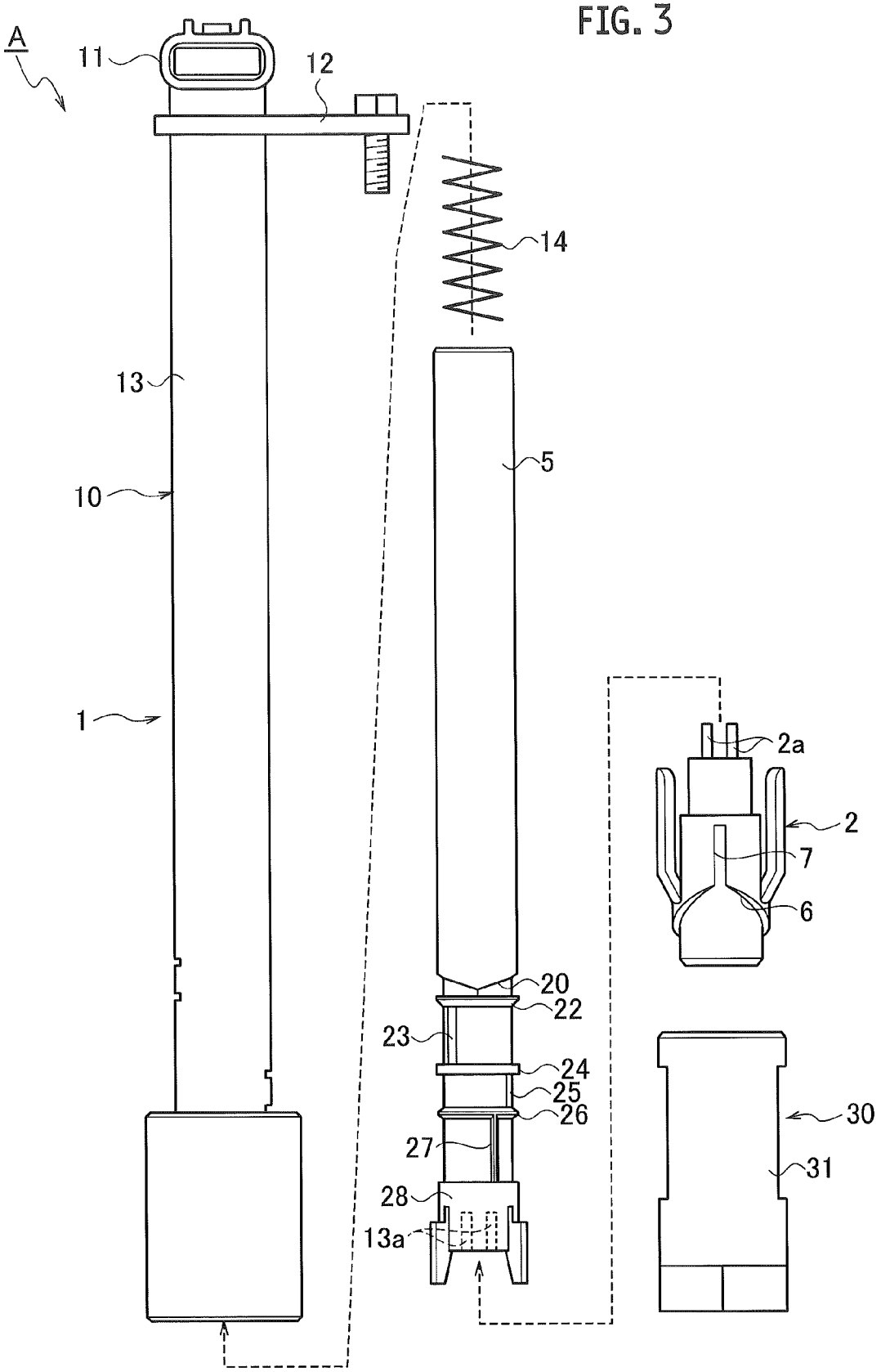
FIG. 3 is an exploded front view of the connector device according to the first embodiment.
Figure 4:
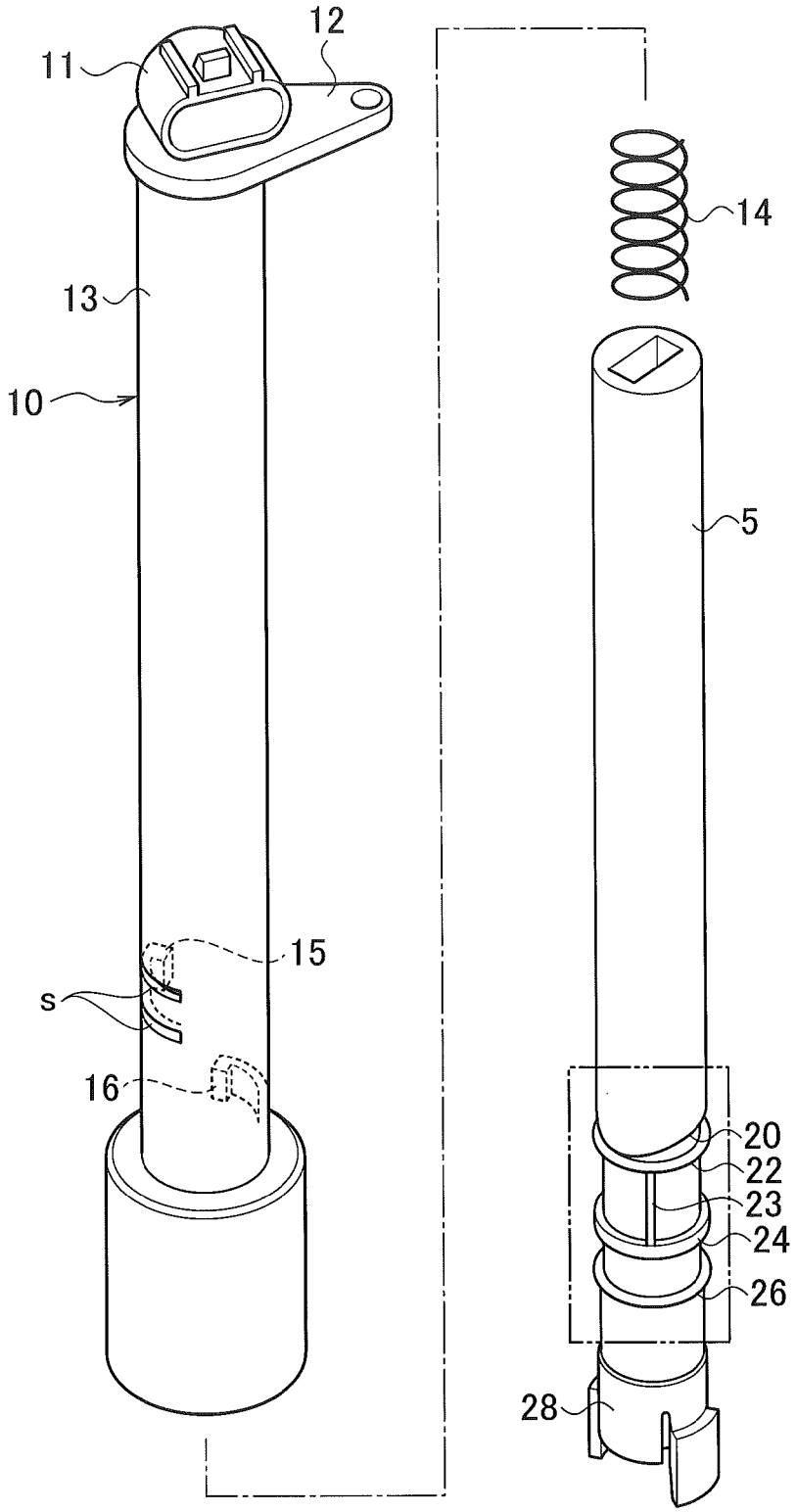
FIG. 4 is an exploded perspective view of an essential part of the connector device according to the first embodiment.

Subsequently, when advancing the fitting of the first housing part 2, the guide rib 32 enters the guide groove 7 and is inserted thereinto up to the completion position where the first housing part 2 is fitted to the second housing part 31, as illustrated in FIG. 2. That is, each of the first guide pin 15 and the second guide pin 16 moves from the point C up to the point D in FIGS. 7A and 7B. During the process where the guide rib 32 advances in the guide groove 7, the first terminal and the second terminal start to connect with each other and then, they are brought into an appropriate connecting condition at the fitting completion position. Thus, the fitting operation of the wire harness side connector 1 is completed.

Meanwhile, if the fitting between the first housing part 2 and the second housing part 31 is started in their formal fitting rotational positions, then the guide rib 32 directly enters the guide groove 7 without sliding on the guide rail face 6 and is inserted thereinto up to the completion position. In this fitting process, the first housing part 2 is subjected to an external force pressing it upward in the axial direction, so that the first housing part 2 and the third housing part 10 are moved to the fitting completion position. Thus, the third housing part 10 becomes rotatable to the first housing part 2 and thus the second housing part 31.

If it is required to adjust the orientation of the opening of the external connector fitting part 11, the third housing part 10 is rotated for the adjustment.

In order to release the connector fitting, an external force is applied in a direction to make the third housing part 10 apart from the sensor side connector 30. Then, as the pressing force from the second housing part 31 to the first housing part 2 is released gradually, the first housing part 2 returns from the fitting completion position to the pre-fitting position by the elastic force of the spring 14. If the first guide pin 15 is located in any position except for the initial rotational position, it abuts on the guide rail 20 other than the uppermost position in this returning process and then returns to the pre-fitting position while being guided by the guide rail 20. That is, each of the first guide pin 15 and the second guide pin moves from the point E up to point G in FIGS. 8A and 8B.

In the connector device A, as described above, if the fitting orientation of the first housing part 2 is different from the fitting orientation of the second housing part 31, then the first housing part 2 rotates in relation to the third housing part 10 thereby accomplishing the fitting with the second housing part 31. Under the resulting connector fitting completion condition, the first terminal and the second terminal are connected to each other. The first housing part 2 is adapted so as to be movable in relation to the third housing part 10 between the pre-fitting position and the fitting completion position in the axial direction and also urged toward the pre-fitting position by the spring 14. The rotational position return mechanism is provided that returns, when the connector fitting is released, the rotational position of the first housing part 2 to the initial rotational position during the process in which the first housing part 2 is moved from the fitting completion position to the pre-fitting position by the elastic force of the spring. Therefore, in this state, it is possible to execute the connector fitting operation and also possible to prevent the wires W from being twisted to the utmost because the withdrawal of the connector device A from its fitting state brings the wires W into non-twisting condition.

The rotation preventing mechanism is provided to prevent the first housing part 2 under the pre-fitting position from rotating in relation to the third housing part 10. Therefore, even if a rotating force is applied to the first housing part 2 under the connector-fitting releasing condition (i.e. the connector pre-fitting condition), the first housing part 2 does not rotate in relation to the third housing part 10. Thus, it is possible to prevent the wires W from being twisted, certainly. In the first embodiment, the rotation of the first housing part 2 is blocked between the pre-fitting position and the rotation starting position. Therefore, even if it is attempted to rotate the first housing part 2 while pressing it into the third housing part 10 under condition that the wire harness side connector 1 is in the pre-fitting condition, the first housing part 2 does not rotate absolutely. Accordingly, the twisting of the wires W can be prevented certainly.

The rotational position return mechanism includes the guide rail 20 arranged in the inner cylindrical body 5 of the first housing part 2, and the first guide pin 15 arranged in the outer cylindrical body 13 of the third housing part 10 and also guided by the guide rail 20 during the process in which the first housing part 2 moves from the fitting completion position up to the pre-fitting position in the axial direction. Thus, owing to the simple provision of the guide rail 20 in the first housing part 2 and the first guide pin 15 in the third housing part 10, it is possible to construct the rotational position return mechanism with ease. Alternatively, the first guide pin 15 may be arranged in the first housing part, provided that the guide rail 20 is arranged in the third housing part 10.

Second Embodiment

Figure 9:
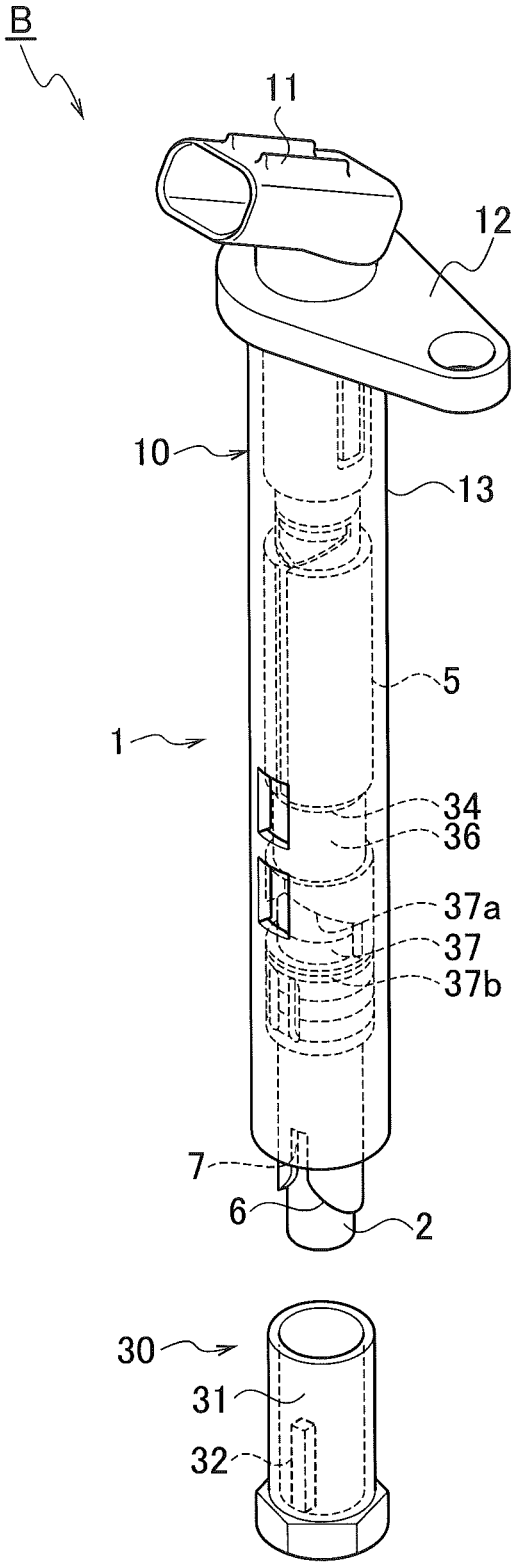
FIG. 9 is a perspective view of a connector device according to a second embodiment.
Figure 10A:
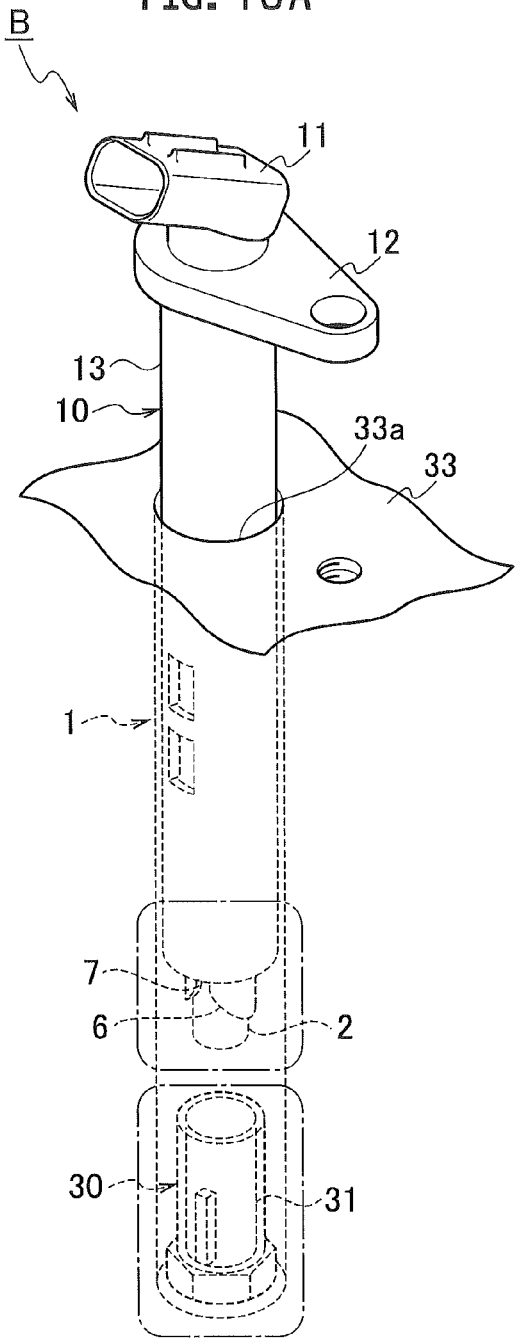
FIG. 10A is perspective view of the connector device according to the second embodiment in a pre-fitting condition.
Figure 10B:
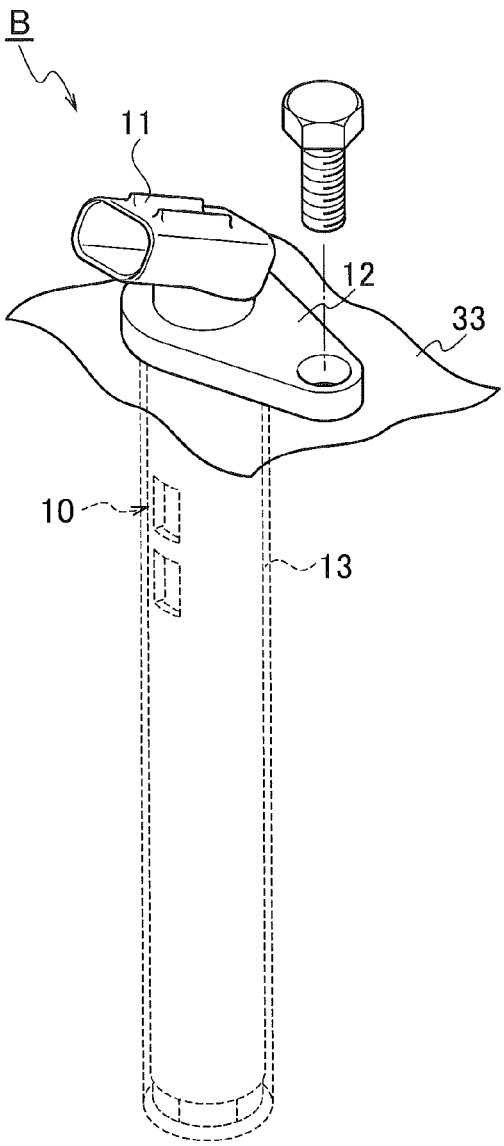
FIG. 10B is a perspective view of the connector device according to the second embodiment in a fitting completion condition.
Figure 11:
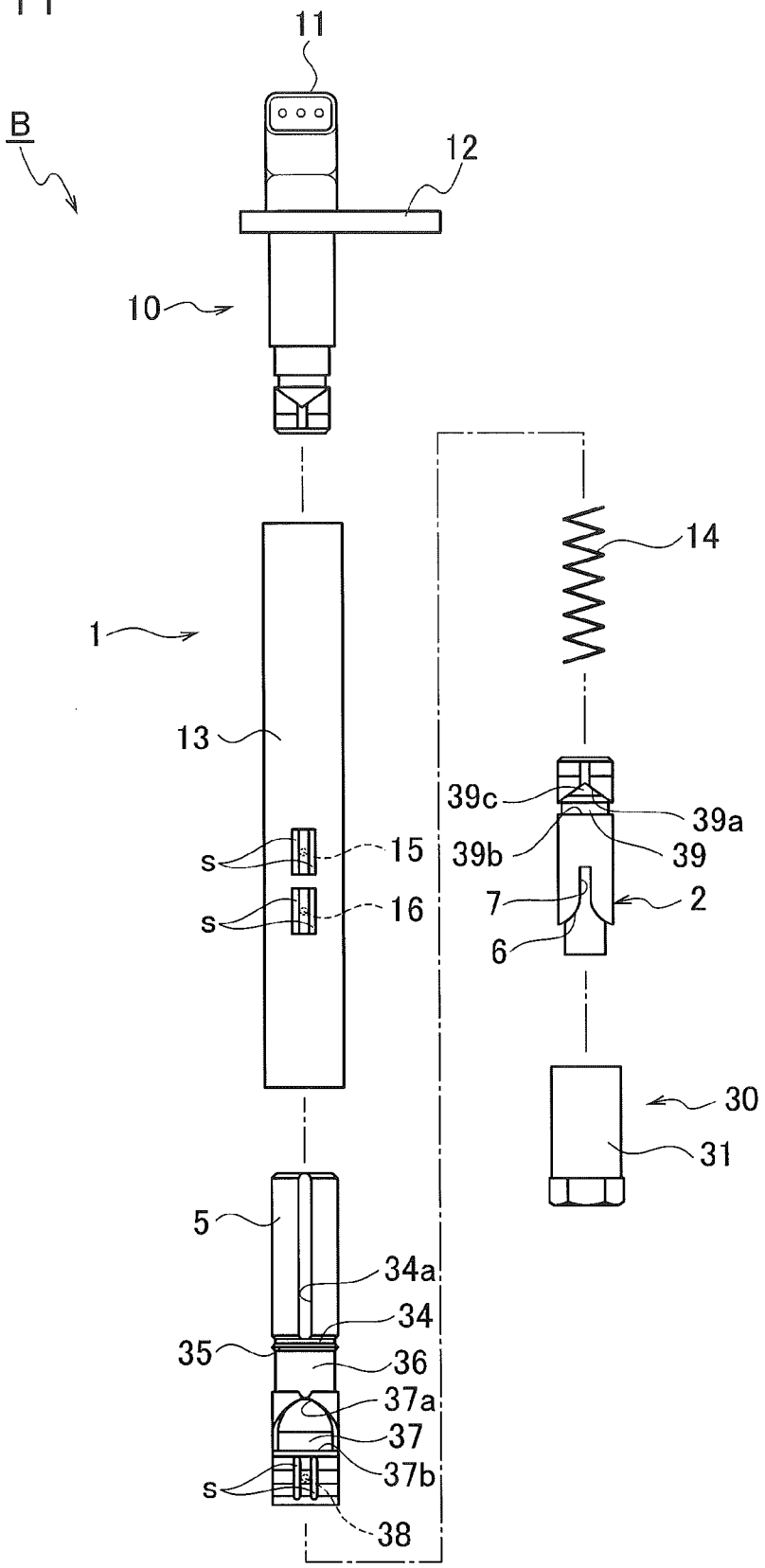
FIG. 11 is an exploded front view of the connector device according to the second embodiment.

FIGS. 9 to 16 illustrate a second embodiment. As illustrated in FIGS. 9 to 11, a connector device B according to the second embodiment includes a built-in combustion pressure sensor (not illustrated) and is mounted on e.g. an engine head. The connector device B includes the wire harness side connector 1 as the first connector and the sensor side connector 30 as the second connector.

The wire harness side connector 1 includes the first housing part 2 having the built-in first terminal (not illustrated), and a third housing part 10 rotatably arranged in relation to the first housing part 2. On the top of the first housing part 2, the inner cylindrical body 5 is rotatably arranged so as to partially overlap with the part 2, coaxially.

The third housing part 10 includes the external connector fitting part 11 having the built-in third terminal (not illustrated), the attachment flange part 12, and the outer cylindrical body 13 connected to a lower portion of the attachment flange part 12. Different from the first embodiment, the external connector fitting part 11, the attachment flange part 12, and the outer cylindrical body 13 are composed of two members. The third terminal and the first terminal are connected to each other through the electrical wires W routed in the outer cylindrical body 13. Each of the wires W is routed with a surplus length allowing it to be twisted. The external connector fitting part 11 defines, as its fitting direction, a direction generally perpendicular to the fitting direction of the first housing part 2. Fitted into the external connector fitting part 11 is an external connector (not illustrated) which is connected to a wire harness (not illustrated) on the side of a vehicle body.

As illustrated in FIG. 11, the inner cylindrical body 5 and the first housing part 2 are accommodated inside the outer cylindrical body 13. The inner cylindrical body 5 is movable to the outer cylindrical body 13 in the axial direction and also rotatable about its own axis. The first housing part 2 is movable to the inner cylindrical body 5 in the axial direction and also rotatable about its own axis. That is, the inner cylindrical body 5 and the first housing part 2 are rotatable independently of each other. The lower part of the first housing part 2 is exposed from the lower end of the outer cylindrical body 13. The first housing part 2 is urged against a pre-fitting position by the elastic force of the spring 14 as the urging member housed in the outer cylindrical body 13. However, the axial moving ranges and rotatable positions of the inner cylindrical body 5 and the first housing part 2 in relation to the outer cylindrical body 13 are restricted by the following structure. The structure will be described below.

Figure 12A:
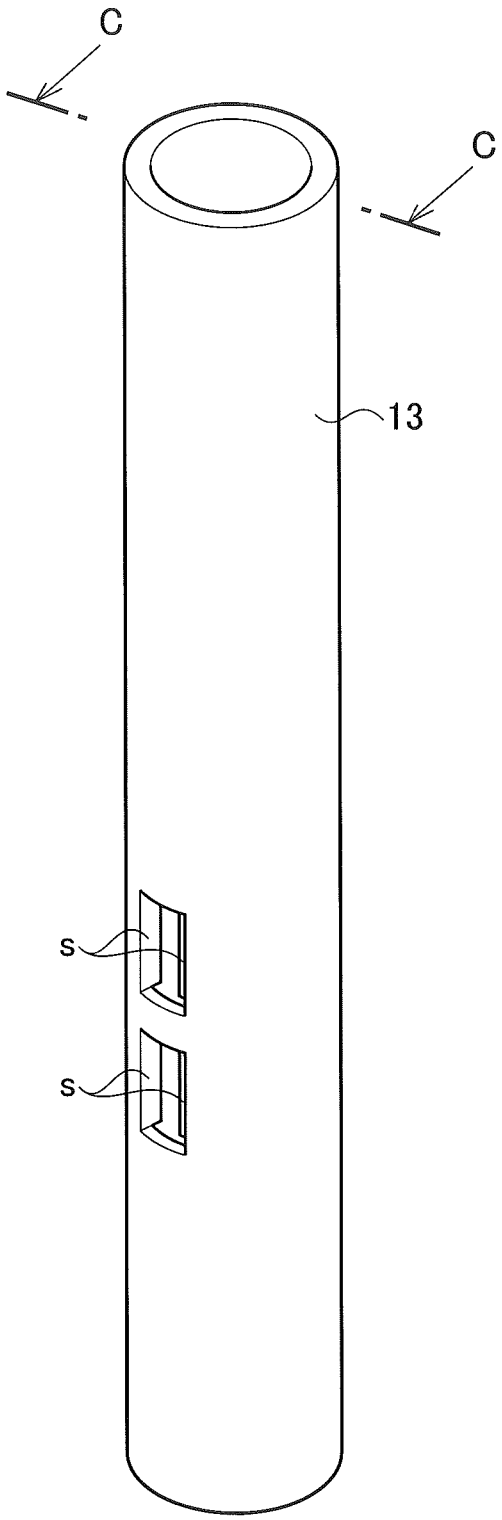
FIG. 12A is a perspective view of an outer cylindrical body of the connector device according to the second embodiment.
Figure 12B:
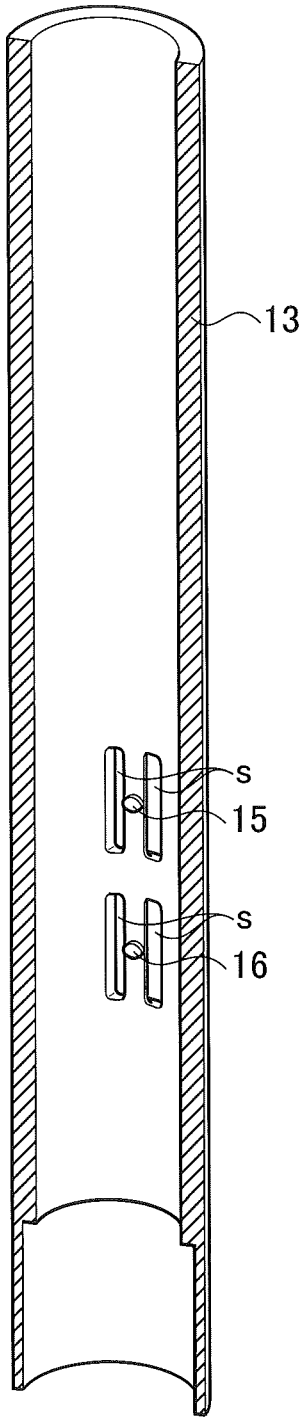
FIG. 12B is a sectional view taken along a line C-C of FIG. 12A.

As illustrated in FIG. 12, the outer cylindrical body 13 is provided with the first guide pin 15 and the second guide pin 16 which protrude from the inner surface of the outer cylindrical body 13. The first guide pin 15 and the second guide pin 16 are arranged in the same rotational positions although they are shifted from each other in the axial direction. With pressing forces applied from the inside, the first guide pin 15 and the second guide pin 16 can withdraw from the inner surface outwardly due to elastic displacements of respective slits s.

Figure 14A:
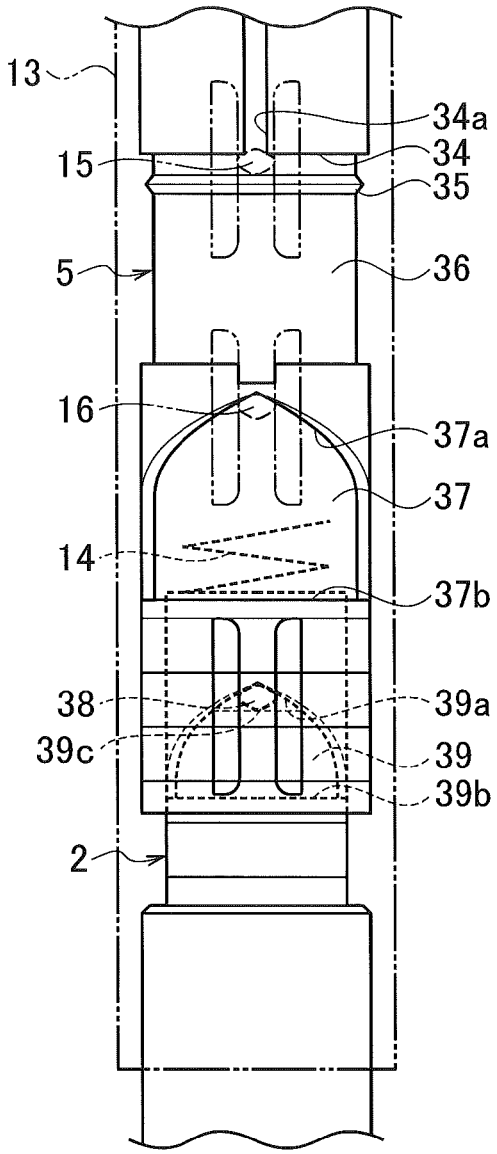
FIG. 14A is a view illustrating the positions of first to third guide pins of the connector device according to the second embodiment, in a pre-fitting position.
Figure 14B:
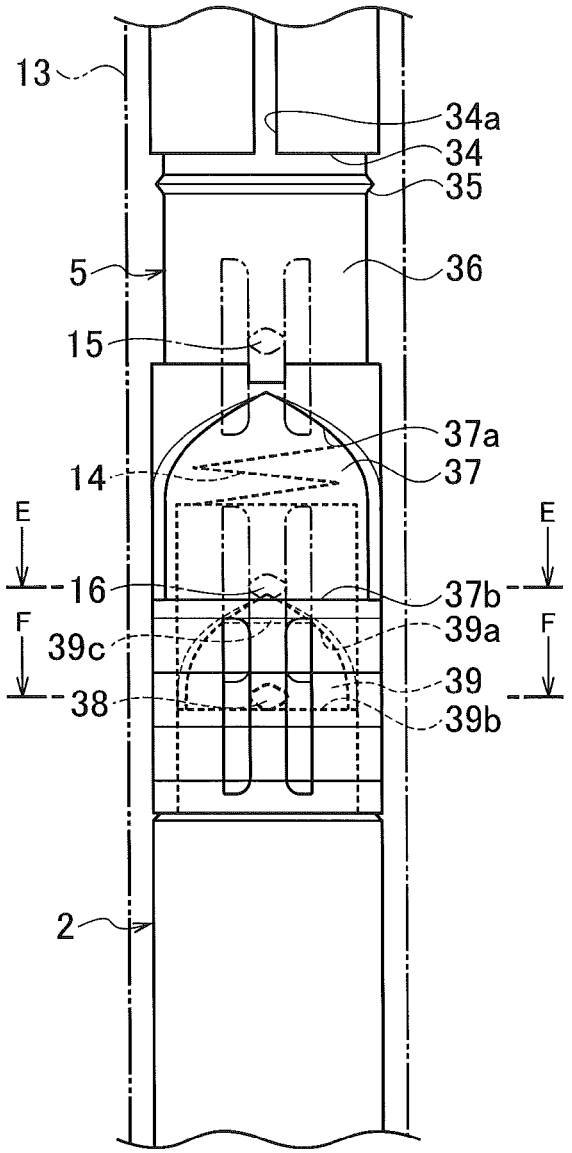
FIG. 14B is a view illustrating the positions of the first to third guide pins of the connector device according to the second embodiment, in a fitting completion position.
Figure 15A:
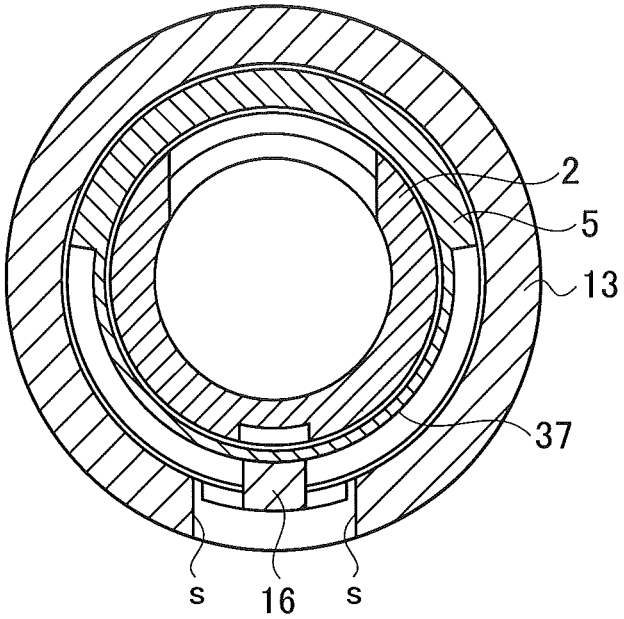
FIG. 15A is a sectional view taken along a line E-E of FIG. 14B.
Figure 15B:
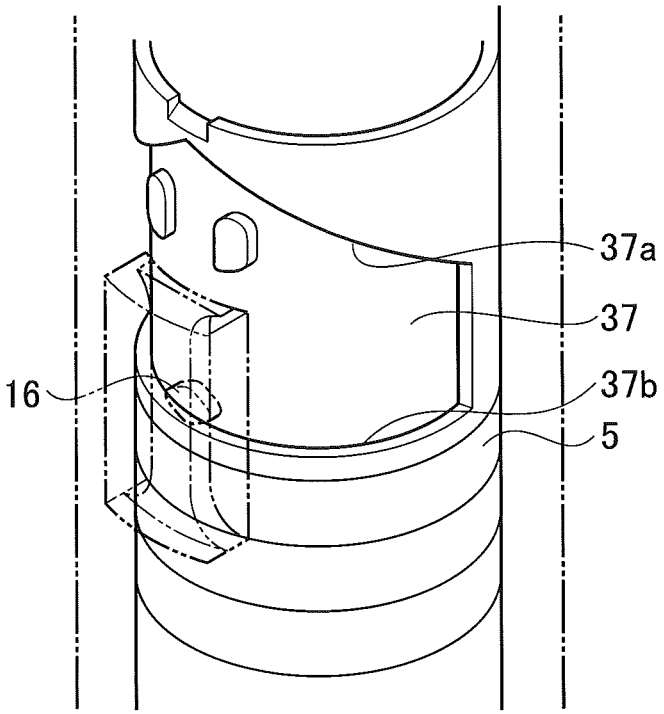
FIG. 15B is a perspective view of an essential part, illustrating the position of the second guide pin of the connector device according to the second embodiment, in the fitting completion position.
Figure 16A:
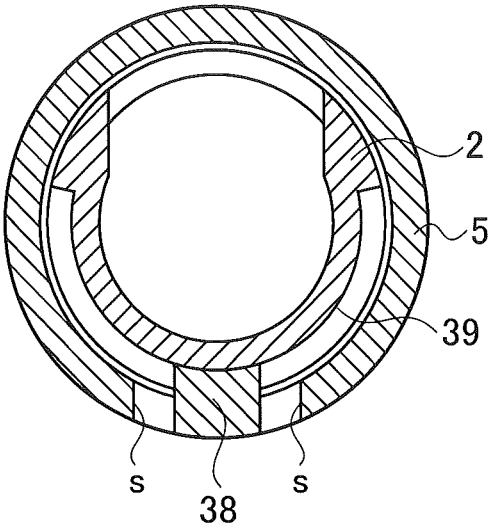
FIG. 16A is a sectional view taken along a line F-F of FIG. 14B.
Figure 16B:
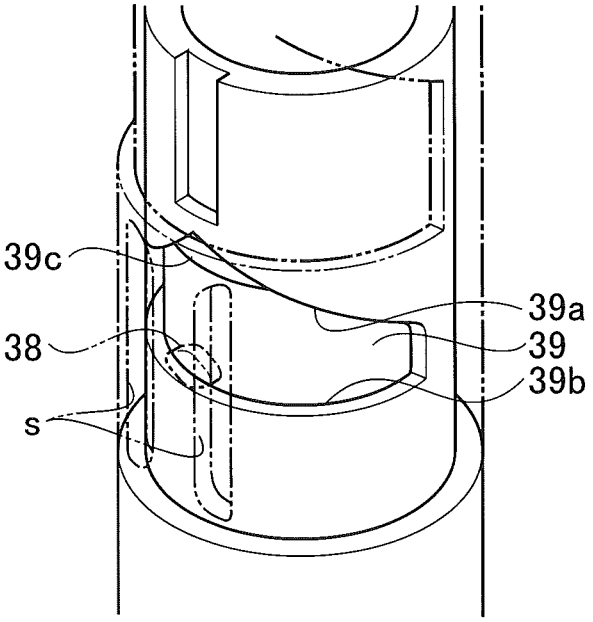
FIG. 16B is a perspective view of an essential part, illustrating the position of the third guide pin of the connector device according to the second embodiment, in the fitting completion position.

As illustrated in FIGS. 11, 14A, and 14B, the inner cylindrical body 5 is provided, in order from its upper position toward the lower position, with: a locking groove 34 which is formed over the entire circumference in the circumferential direction and above which a vertical groove 34*a* is arranged so as to open to the locking groove 34 in a position corresponding to the initial rotational position; an annular horizontal restriction wall 35 formed over the entire circumference in the circumferential direction; a rotation allowable circumferential face 36 also formed over the entire circumference in the circumferential direction; a first rotation allowable concave part 37 arranged over the rotating area of 180 degrees in the circumferential direction; a first guide rail 37*a* formed by a step surface above the first rotation allowable concave part 37; and a stop face 37*b* formed by a step surface below the first rotation allowable concave part 37.

In the pre-fitting position of the inner cylindrical body 5, as illustrated in FIG. 14A, the inner cylindrical body 5 is subjected to the elastic force of the spring 14, since the first guide pin 15 is engaged in the locking groove 34 while the second guide pin 16 abuts on the uppermost position of the first guide rail 37*a*. Consequently, the inner cylindrical body 5 is adapted so as not to fall off from the downside of the outer cylindrical body 13 under the connector pre-fitting (connector fitting releasing) condition.

In the connector fitting completion position of the inner cylindrical body 5, as illustrated in FIG. 14B, the inner cylindrical body 5 is subjected to pressing force from the sensor side connector 30 since the second guide pin 16 abuts on the stop face 37*b*. Thus, in the connector fitting condition, the inner cylindrical body 5 is adapted so as not to enter the interior of the outer cylindrical body 13 anymore.

In the pre-fitting position of the inner cylindrical body 5, the first guide pin 15 gets into the locking groove 34 thereby preventing the inner cylindrical body 5 from being rotated in both directions in relation to the third housing part 10. That is, in the pre-fitting position, the first guide pin 15 and the locking groove 34 block the rotation of the inner cylindrical body 5 in relation to the third housing part 10.

The first guide rail 37*a* is a generally circumferential step surface which is the highest at the initial rotational position of the first guide pin 15 and whose height is gradually lowered as increasing the rotational angle from the initial rotational position. The first rotation allowable concave part 37 and the first guide rail 37*a* are established to be circumferential surfaces in respective ranges of rotating angles of 90 degrees to the left and right from the initial position as a center. When the first housing part 2 returns from the connector fitting completion position to the pre-fitting position due to elastic force of the spring 14 at the time of releasing the connector fitting, the first guide pin 15 returns to the initial rotational position while being guided by the first guide rail 37*a*. Therefore, the first guide pin 15 and the first guide rail 37*a* return the rotational position of the inner cylindrical body 5 to the initial rotational position during a process where the inner cylindrical body 5 is moved from the fitting completion position to the pre-fitting position by the elastic force of the spring 14.

In the horizontal restriction wall 35, its faces on which the first guide pin 15 abuts in moving from the pre-fitting completion position to the fitting completion position and vice versa, i.e. from the fitting completion position to the pre-fitting position are formed to be tapered surfaces, respectively. Thus, the first guide pin 15 is adapted so as to be movable over the horizontal restriction wall 35 owing to its elastic displacement.

Figure 13A:
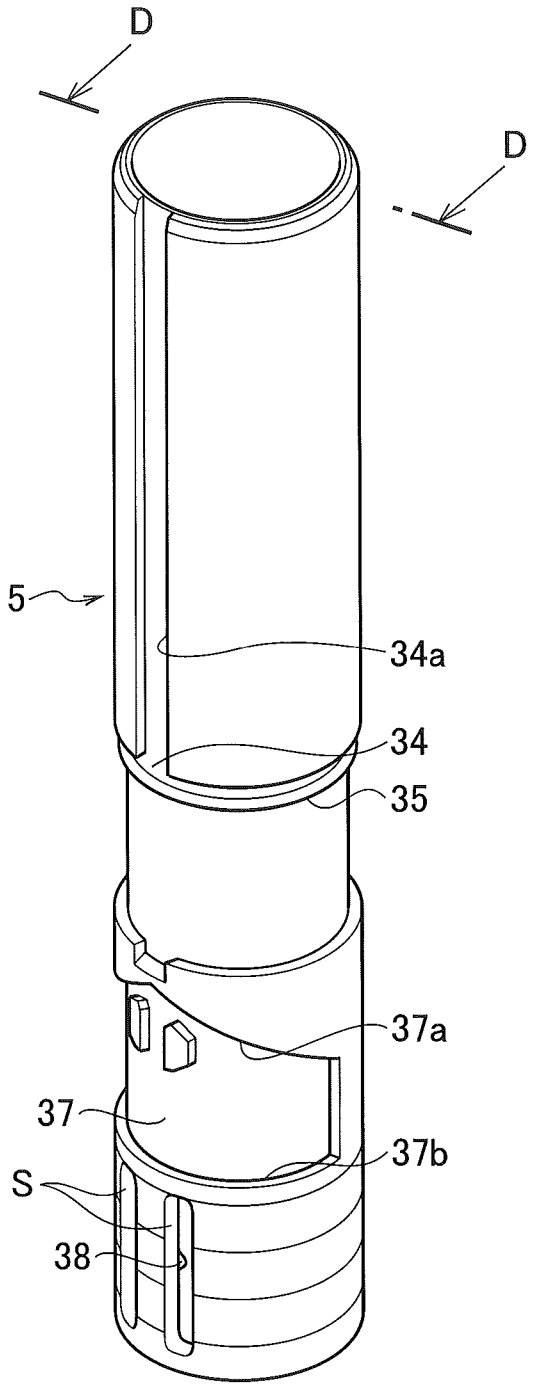
FIG. 13A is a perspective view of an inner cylindrical body of the connector device according to the second embodiment.
Figure 13B:
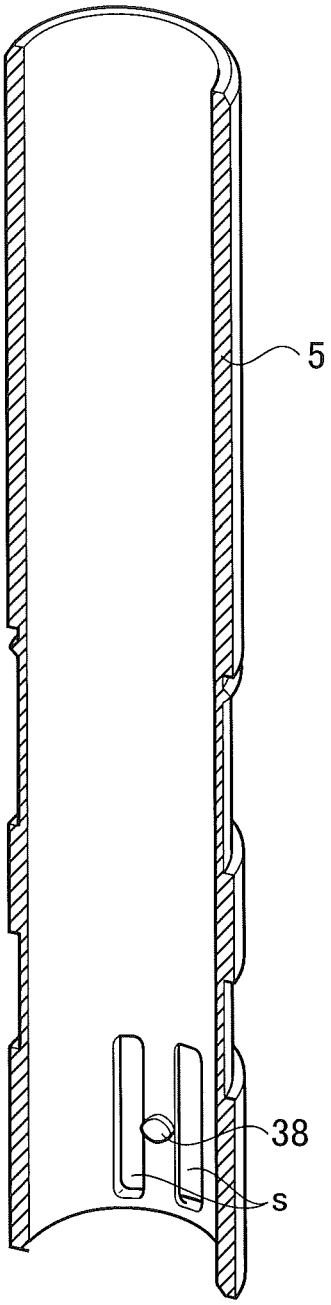
FIG. 13B is a sectional view taken along a line D-D of FIG. 13A.

As illustrated in FIGS. 13A and 13B, the first housing part 2 is provided with a third guide pin 38 which protrudes from the inner surface of the first housing part 2. With pressing forces applied from the inside, the third guide pin 38 can withdraw from the inner surface outwardly due to its elastic displacement.

As illustrated in FIGS. 14A and 14B, the first housing part 2 is provided with a second rotation allowable concave part 39 arranged over the rotating area of 180 degrees in the circumferential direction, a second guide rail 39*a* formed by a step surface above the second rotation allowable concave part 39, a stop face 39*b* formed by a step surface below the second rotation allowable concave part 39, and a locking step face 39*c* formed by an upper side of the second rotation allowable concave part 39, which is higher than its surroundings.

In the pre-fitting position of the first housing part 2, as illustrated in FIG. 14A, the first housing part 2 is subjected to elastic force of the spring 14 since the third guide pin 38 abuts on the uppermost position of the second guide rail 39*a*. Consequently, the first housing part 2 is adapted so as not to fall off from the downside of the outer cylindrical body 13 under the connector pre-fitting (connector fitting releasing) condition.

In the connector fitting completion position of the first housing part 2, as illustrated in FIG. 14B, the first housing part 2 is subjected to pressing force from the sensor side connector 30 since the third guide pin 38 abuts on the stop face 39*b*. Thus, in the connector fitting condition, the first housing part 2 is adapted so as not to enter the interior of the outer cylindrical body 13 anymore.

In the pre-fitting position of the first housing part 2, the third guide pin 38 is positioned on the locking step part 39*c*, which is higher than its surroundings, under condition of abutting on the second guide rail 39*a* thereby preventing the first housing part 2 from being rotated in both directions in relation to the third housing part 10. The second guide pin 16 is elastically displaced to its outside due to the slits s. As a result, with strong return force of the elastic displacement, the second guide pin comes into pressure contact with the locking step face 39*c* thereby preventing the rotation in both directions. That is, the third guide pin 38 and the locking step face 39*c* block the rotation of the first housing part 2 in relation to the inner cylindrical part 5 in the pre-fitting position. From above, the above mentioned first guide pin 15 and the locking groove 34; and the third guide pin 38 and the locking step face 39*c* constitute, in combination, a rotation preventing mechanism which stops the rotation of the first housing part 2 in relation to the third housing part 10 in the pre-fitting position.

The second guide rail 39*a* is a circumferential step surface which is the highest at the initial rotational position of the third guide pin 38 and whose height is gradually lowered as increasing the rotational angle from the initial rotational position. The second rotation allowable concave part 39 and the second guide rail 39*a* are established to be circumferential surfaces in respective ranges of rotating angles of 90 degrees to the left and right from the initial position as a center. When the first housing part 2 returns from the connector fitting completion position to the pre-fitting position due to elastic force of the spring 18 at the time of releasing the connector fitting, the third guide pin 38 returns to the initial rotational position while being guided by the second guide rail 39*a*. Therefore, the third guide pin 38 and the second guide rail 39*a* return the rotational position of the first housing part 2 to the initial rotational position during a process where the first housing part 2 is moved from the fitting completion position to the pre-fitting position by the elastic force of the spring 14. From above, the above mentioned first guide pin 15 and the first guide rail 37*a;* and the third guide pin 38 and the second guide rail 39*a* constitute, in combination, a rotational position return mechanism that returns the first housing part 2 and the inner cylindrical body 5 to the initial rotational position.

On the outer circumference of the first housing part 2 on the side of its lower end, the guide rail face 6 is formed as the rotating direction guide part. The guide rail face 6 is a circumferential rail surface which is the highest at a later mentioned formal fitting rotational position with the second housing part 2 and whose height is gradually lowered as increasing the rotational angle from the fitting rotational position. The guide rail face 6 serves to guide the later mentioned guide rib 32 up to its appropriate fitting rotational position by the time when the first terminal and the second terminal start to come into contact with each other.

The first housing part 2 is formed, on its outer circumference, with the straight guide groove 7 which opens at the highest position of the guide rail face 6 and extends vertically upward.

The sensor side connector 30 includes a second housing part 31. The second housing part 31 has a built-in sensor element (not illustrated) located on the side of its lower end. The second housing part 31 is formed, on the outer circumference of the lower end, with a threaded part (not illustrated). By screwing the threaded part of the second housing part 31 into a threaded hole (not illustrated) of a cylinder head (not illustrated), the sensor side connector 30 is mounted to the cylinder head. The second housing part 31 is cylindrical shaped and formed so as to open at its top surface. The second terminal (not illustrated) is arranged in the second housing part 31. The second terminal is provided to pick up an output from the sensor element.

The guide rib 32 is formed so as to project from an inner surface of the second housing part 31. When the tip of the guide rib 32 abuts on the guide rail face 6, the first housing part 2 is rotated in a manner that the guide rib 32 moves up to the highest position of the guide face 6 by a fitting position previous to the time when the first terminal and the second terminal start to come into contact with each other, so that the first housing part 2 and the second housing part 31 move to the formal fitting rotational positions. Thereafter, the guide rib 32 enters the guide groove 7 to initiate a contact between the first terminal and the second terminal. Then, at the fitting completion position where the guide rib 32 penetrates deep into the guide groove 7, the first terminal and the second terminal come into contact with each other appropriately.

With the above mentioned constitution, as illustrated in FIG. 10A, the sensor side connector 30 is installed in a cylinder head (not illustrated) and thereafter, the head cover 33 is mounted on the cylinder head. In the head cover 33, the hole 33*a* is formed at the fitting position of the sensor side connector 30. The wire harness side connector 1 is fitted into the head cover through the hole 33*a*.

Here, in the wire harness side connector 1, the first housing part 2 is located in the pre-fitting position. In the pre-fitting position, as illustrated in FIG. 14A, the first guide pin 15 gets into the locking groove 34 while the third guide pin 30 is located on the locking step face 39*c,* so that normal/reverse rotation between the first housing part 2 and the third housing part 10 is blocked. In this way, it becomes possible to prevent the wires W from being twisted before starting the fitting operation.

Next, the fitting operation of the wire harness side connector 1 will be described. On the assumption of setting the orientation (rotating position) of the external connector fitting part 11 to a desired orientation, it is performed to insert the wire harness side connector 1 into the second housing part 31 of the sensor side connector 30 through the hole 33*a* of the head cover 33. Then, except a situation where the first housing part 2 is inserted into the second housing part 31 at the formal fitting rotational position, the guide rib 32 of the second housing part 31 abuts on an arbitrary part of the guide rail face 6 of the first housing part 2

When further advancing the fitting from this state, an upward pressing force acts on the first housing part 2 by a reaction force from the guide rib 32, so that the first housing part 2 moves in relation to the third housing part 10 toward the fitting completion position while resisting the elastic force of the spring 14. Consequently, the first guide pin 15 climbs over the horizontal restriction wall 35 and gets into the rotation allowable circumferential face 36. The second guide pin 16 is positioned away from the first guide rail 37*a* in the first rotation allowable concave part 37. Further, the third guide pin 38 is located off the locking step face 39*c* of the second rotation allowable concave part 39. As a result, the first housing part 2 becomes rotatable to the inner cylindrical body 5, while the inner cylindrical body 5 becomes rotatable to the third housing part 10. Then, the first housing part 2 is rotated while being guided by the guide rail face 6 and the guide ribs 32, and subsequently, the first housing part 2 occupies a rotational position where the guide rib 32 is located at the uppermost position of the guide rail face 6. Thus, the first housing part 2 and the second housing part 31 are brought into the formal fitting rotational positions.

Subsequently, when advancing the fitting of the first housing part 2, the guide rib 32 enters the guide groove 7 and is inserted thereinto up to the completion position where the first housing part 2 is fitted to the second housing part 31, as illustrated in FIG. 10B. During the process where the guide rib 32 advances in the guide groove 7, the first terminal and the second terminal start to connect with each other and then, they are brought into an appropriate connecting condition at the fitting completion position. Thus, the fitting operation of the wire harness side connector 1 is completed.

Meanwhile, if the fitting between the first housing part 2 and the second housing part 31 is started in the formal fitting rotational positions, then the guide rib 32 directly enters the guide groove 7 without sliding on the guide rail face 6 and is inserted thereinto up to the completion position. In this fitting process, the first housing part 2 is subjected to an external force pressing it upward in the axial direction, so that the first housing part 2 and the third housing part 10 are moved to the fitting completion position. Thus, the third housing part 10 becomes rotatable to the first housing part 2 and thus the second housing part 31.

If it is required to adjust the orientation of the opening of the external connector fitting part 11, the third housing part 10 is rotated for the adjustment.

In order to release the connector fitting, an external force is applied in a direction to make the third housing part 10 apart from the sensor side connector 30. Then, as the pressing force from the second housing part 31 to the first housing part 2 is released gradually, the first housing part 2 returns from the fitting completion position to the pre-fitting position by the elastic force of the spring 14. The first guide pin 15 climbs over the horizontal vertical wall 35 and returns to a position on a level with the locking groove 34 in this returning process. The second guide pin 16, when it is located in any position except for the initial rotational position, abuts on the first guide rail 37*a* other than the uppermost position in this returning process, so that the inner cylindrical body 5 returns to the pre-fitting position while being guided by the guide rail 20. The third guide pin 38, when it is located in any position except for the initial rotational position, abuts on the second guide rail 39*a* other than the uppermost position in this returning process, so that the first housing part 2 returns to the pre-fitting position while being guided by the second guide rail 39*a*. That is, the first housing part 2 and the inner cylindrical body 5 together return to the pre-fitting positions while rotating toward the initial rotational positions.

In the connector device B, as described above, if the fitting orientation of the first housing part 2 is different from the fitting orientation of the second housing part 31, then the first housing part 2 rotates in relation to the third housing part 10 thereby accomplishing the fitting with the second housing part 31. Under the resulting connector fitting completion condition, the first terminal and the second terminal are connected to each other. The first housing part 2 is adapted so as to be movable in relation to the third housing part 10 between the pre-fitting position and the fitting completion position in the axial direction and also urged toward the pre-fitting position by the spring 14. The rotational position return mechanism is provided that returns, when the connector fitting is released, the rotational position of the first housing part 2 to the initial rotational position during the process in which the first housing part 2 is moved from the fitting completion position to the pre-fitting position by the elastic force of the spring. Therefore, in this state, it is possible to execute the connector fitting operation and also possible to prevent the wires W from being twisted to the utmost because the withdrawal of the connector device B from its fitting state brings the wires W into non-twisting condition.

The rotation preventing mechanism is provided to prevent the first housing part 2 under the pre-fitting position from rotating in relation to the third housing part 10. Therefore, even if a rotating force is applied to the first housing part 2 under the connector-fitting releasing condition (i.e. the connector pre-fitting condition), the first housing part 2 does not rotate in relation to the third housing part 10. Thus, it is possible to prevent the wires W from being twisted, certainly.

The rotational position return mechanism includes the second guide pin 16 provided in the third housing part 10, the first guide rail 37*a* provided in the inner cylindrical body 5, the third guide pin 38 provided in the inner cylindrical body 5, and the second guide rail 39*a* provided in the first housing part 2. Thus, as the first housing part 2 and the inner cylindrical body 5 rotate in relation to the third housing part 10 respectively, the rotational range to the third housing part 10 is allocated to the first housing part 2 and the inner cylindrical body 5, thereby allowing respective rotational ranges of the first housing part 2 and the inner cylindrical body 5 to be reduced. Therefore, if the rotational range required for the first housing part 2 in relation to the third housing part 10 is 180 degrees on the right and left sides, the first guide rail 37*a* and the second guide rail 39*a* may be formed between the third housing part 10 and the inner cylindrical part 5 and between the inner cylindrical part 5 and the first housing part 2 respectively, with the rotational range of 90 degrees on the right and left sides with respect to each guide rail. Alternatively, the first guide rail 37*a* may be arranged in the third housing part 10, provided that the second guide pin 16 is arranged in the inner cylindrical body 5. Or, the second guide rail 39*a* may be arranged in the inner cylindrical body 5, provided that the third guide pin 38 is arranged in the first housing part 2.

Modification of Second Embodiment

Figure 17:
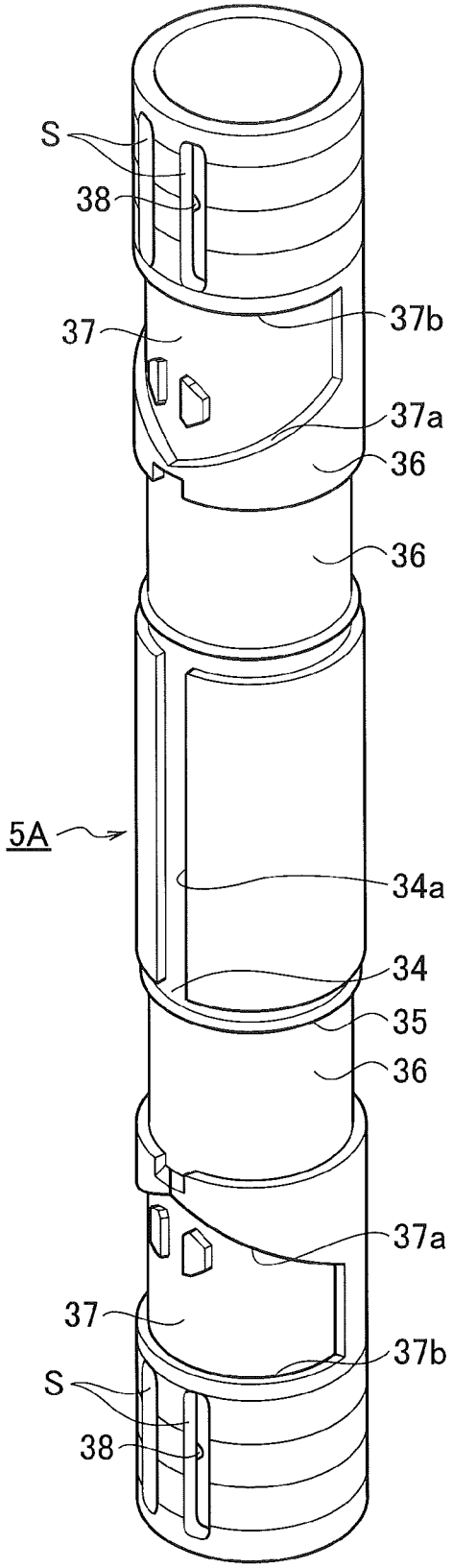
FIG. 17 is a perspective view of an inner cylindrical body according to a modification of the inner cylindrical body of the connector device according to the second embodiment.
Figure 18:
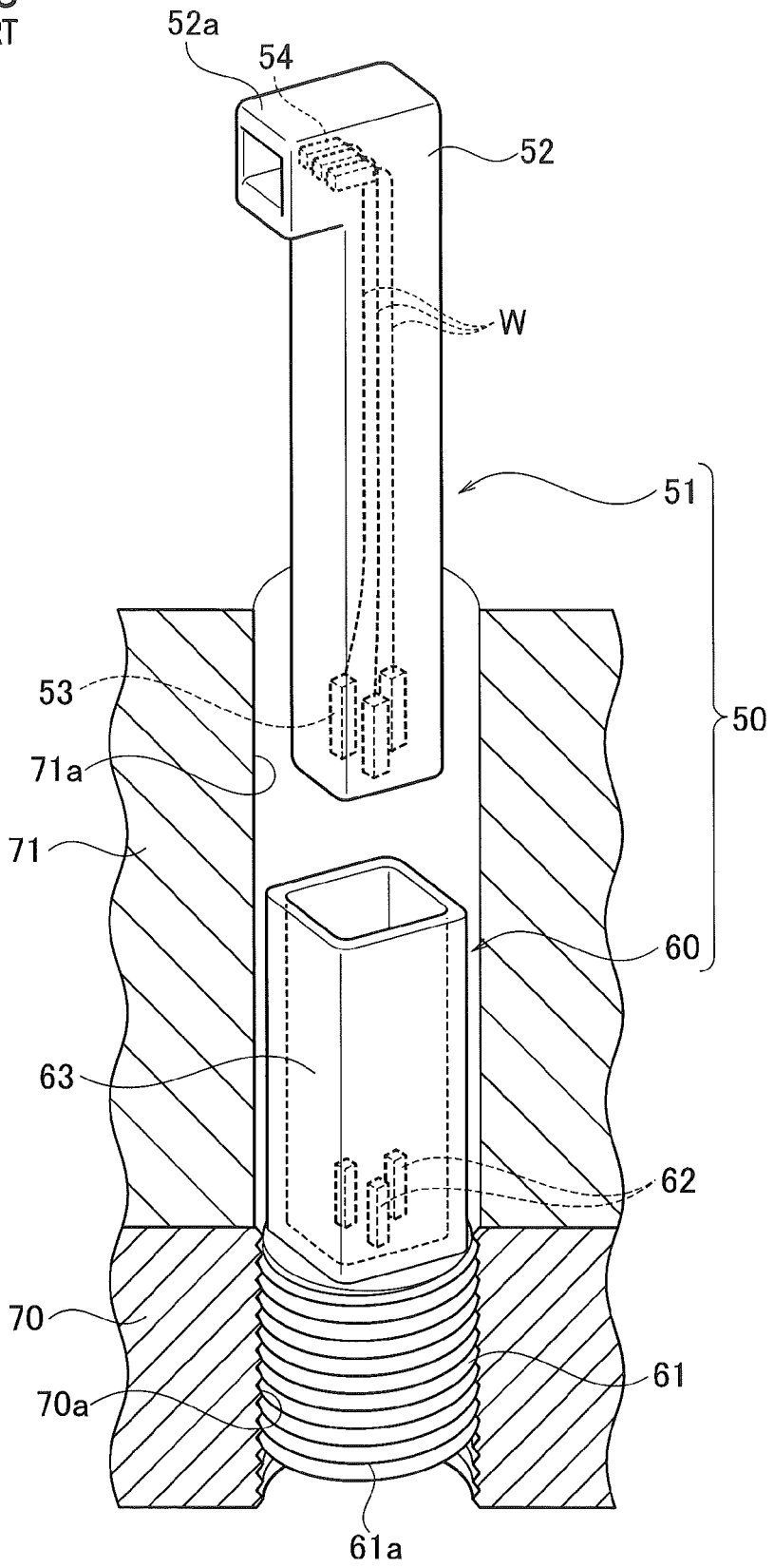
FIG. 18 PRIOR ART
FIG. 18 is a perspective view of a conventional connector device in a pre-fitting condition.

FIG. 17 illustrates a modification of the inner cylindrical body 5A of the second embodiment. The inner cylindrical body 5A of the modification is provided, in vertically symmetric positions, with the first rotation allowable concave parts 37, the first guide rails 37*a*, the stop faces 37*b*, and the third guide pins 38.

With use of the inner cylindrical body 5A according to the modification, it is possible to assemble the inner cylindrical body 5A from either of upper and lower directions, offering improved assembling workability.

In connection, if the first guide rails 37*a* are provided in the third housing part 10, the second guide pins 16 are arranged in vertically symmetric positions of the inner cylindrical body 5A, respectively. If the third guide pins 38 are provided in the first housing part 2, the second guide rails 39*a* are arranged in vertically symmetric positions of the inner cylindrical body 5A, respectively.

Modifications Etc. of Respective Embodiments

In common with the first embodiment and the second embodiment, the guide rail face 6 is formed in the first housing part 2 of the wire harness side connector 1, while the guide rib 32 is formed in the second housing part 31 of the sensor side connector 30. To the contrary, the guide rib 32 may be formed in the first housing part 2 of the wire harness side connector 1, provided that the guide rail face 6 is formed in the second housing part 31 of the sensor side connector 30.

Although each of the connector device A according to the first embodiment and the connector device B according to the second embodiment is equipped with the combustion pressure sensor element (not illustrated) integrally and further installed in the cylinder head of the engine, the present application is not limited to these arrangements. The present application is applicable to a connector device, for example, whether or not a sensor element is present and also applicable to even a connector device integrally equipped with a component other than the sensor element. Although the connector device of the present application is effective in a situation that a counterpart side housing part cannot be identified visually, the present application is available in even a situation that the counterpart side housing part is visible. That is, it is possible to perform the fitting operation without giving consideration to the orientation (rotational position) of the counterpart side housing part, with ease.

What is claimed is:

1. A connector device, comprising:

a first connector including a first housing part in which a first terminal is disposed; and a second connector including a second housing part in which a second terminal is disposed, the first connector including a third housing part provided so as to be rotatable to the first housing part, the third housing part provided with an external connector fitting part in which a third terminal is disposed, the third terminal and the first terminal connected to each other through a wire;

when a fitting orientation of the first housing part is different from a fitting orientation of the second housing part, the first housing part rotating in relation to the third housing part, thereby fitting the second housing, the first terminal to be connected to the second terminal under condition that fitting of the connectors is complete, the first housing part axially movable to the third housing part between a pre-fitting position thereof and a fitting completion position thereof, the first housing part being urged toward the pre-fitting position by an urging member; and a rotational position return mechanism that returns, when the fitting of the connectors is released, the rotational position of the first housing part to an initial rotation position thereof during a process in which the first housing part is moved from the fitting completion position to the pre-fitting position by an urging force of the urging member.

2. The connector device of claim 1, further comprising a rotation preventing mechanism that prevents the first housing part under the pre-fitting position from rotating to the third housing part.

3. The connector device of claim 1, wherein the rotational position return mechanism comprises:

a guide rail provided in one of the first housing part and the third housing part; and a guide pin guided by the guide rail during an axial movement of the first housing part from the fitting completion position up to the pre-fitting position.

4. The connector device of claim 1, wherein:

an inner cylindrical body is rotatably attached to the first housing part;

the third housing part is rotatably attached to the first housing part through the inner cylindrical part; and the rotational position return mechanism comprises:

a first guide rail provided in one of the third housing part and the inner cylindrical body;

a second guide pin provided in the other of the third housing part and the inner cylindrical body and also guided by the first guide rail during an axial movement of the first housing part from the fitting completion position up to the pre-fitting position;

a second guide rail provided in one of the inner cylindrical body and the first housing part; and a third guide pin provided in the other of the inner cylindrical body and the first housing part and also guided by the second guide rail during the axial movement of the first housing part from the fitting completion position up to the pre-fitting position.

5. The connector device of claim 4, wherein the inner cylindrical body is provided, in each of vertically symmetric positions thereof, with one of the first guide rail and the second guide pin and one of the second guide rail and the third guide pin.

6. The connector device of claim 1, wherein one of the first housing part and the second housing part is provided with a guide rib, the other of the first housing part and the second housing part is provided with a rotational direction guiding part that guides the guide rib so that even if the guide rib is positioned in any rotational position, the first housing part and the second housing part would be brought into formal fitting rotational positions by a position previous to the time when the first terminal and the second terminal start to come into contact with each other, whereby the first housing part rotates to fit the second housing when the fitting orientation of the first housing part is different from the fitting orientation of the second housing part.

* * * * *